US010197936B2

(12) United States Patent
Onozaki et al.

(10) Patent No.: US 10,197,936 B2
(45) Date of Patent: Feb. 5, 2019

(54) TONER

(71) Applicant: CANON KABUSHIKI KAISHA, Tokyo (JP)

(72) Inventors: Yuto Onozaki, Saitama (JP); Takeshi Hashimoto, Moriya (JP); Ichiro Kanno, Kashiwa (JP); Masayuki Hama, Toride (JP); Hitoshi Sano, Matsudo (JP); Nozomu Komatsu, Toride (JP); Takakuni Kobori, Toride (JP); Hiroyuki Fujikawa, Yokohama (JP); Hayato Ida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/807,766

(22) Filed: Nov. 9, 2017

(65) Prior Publication Data

US 2018/0149992 A1 May 31, 2018

(30) Foreign Application Priority Data

Nov. 25, 2016 (JP) ..... 2016-228676

(51) Int. Cl.

| | |
|---|---|
| ***G03G 9/08*** | (2006.01) |
| ***G03G 9/093*** | (2006.01) |
| ***G03G 9/087*** | (2006.01) |
| ***G03G 9/09*** | (2006.01) |
| ***G03G 9/107*** | (2006.01) |

(52) U.S. Cl.

CPC ..... *G03G 9/09321* (2013.01); *G03G 9/081* (2013.01); *G03G 9/08711* (2013.01); *G03G 9/08755* (2013.01); *G03G 9/08782* (2013.01); *G03G 9/0904* (2013.01); *G03G 9/1075* (2013.01)

(58) Field of Classification Search

CPC ..... G03G 9/09321; G03G 9/08711; G03G 9/08755

USPC ..... 430/110.2

See application file for complete search history.

(56) References Cited

U.S. PATENT DOCUMENTS

| | | | |
|---|---|---|---|
| 5,424,810 | A | 6/1995 | Tomiyama et al. |
| 5,464,722 | A | 11/1995 | Tomiyama et al. |
| 5,700,616 | A | 12/1997 | Kasuya et al. |
| 5,712,073 | A | 1/1998 | Katada et al. |
| 5,968,701 | A | 10/1999 | Onuma et al. |
| 5,972,553 | A | 10/1999 | Katada et al. |
| 6,002,895 | A | 12/1999 | Kasuya et al. |
| 6,007,957 | A | 12/1999 | Kobori et al. |
| 6,020,102 | A | 2/2000 | Fujimoto et al. |

(Continued)

FOREIGN PATENT DOCUMENTS

| | | | |
|---|---|---|---|
| JP | 2000-147829 | A | 5/2000 |
| JP | 2006-267248 | A | 10/2006 |
| JP | 2007-298869 | A | 11/2007 |

OTHER PUBLICATIONS

U.S. Appl. No. 15/687,726, Daisuke Yamashita, filed Aug. 28, 2017.

(Continued)

*Primary Examiner* — Mark A Chapman
(74) *Attorney, Agent, or Firm* — Venable LLP

(57) ABSTRACT

Provided is a toner including toner particles each containing an amorphous polyester resin and a wax, in which: the surface of each of the toner particles has a coating layer; and the coating layer contains one or more kinds of olefin-based copolymers each having a specific ester moiety.

5 Claims, 1 Drawing Sheet

(56) References Cited

U.S. PATENT DOCUMENTS

| | | | |
|---|---|---|---|
| 6,120,961 | A | 9/2000 | Tanikawa et al. |
| 6,156,471 | A | 12/2000 | Kobori et al. |
| 6,203,959 | B1 | 3/2001 | Tanikawa et al. |
| 6,235,441 | B1 | 5/2001 | Tanikawa et al. |
| 6,430,384 | B2 | 8/2002 | Hama et al. |
| 6,653,036 | B1 | 11/2003 | Tanikawa et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 7,112,395 | B2 | 9/2006 | Ida et al. |
| 7,135,263 | B2 | 11/2006 | Kawakami et al. |
| 7,147,980 | B2 | 12/2006 | Itakura et al. |
| 7,147,981 | B2 | 12/2006 | Fujikawa et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,361,441 | B2 | 4/2008 | Itakura et al. |
| 7,396,626 | B2 | 7/2008 | Fujikawa et al. |
| 7,396,629 | B2 | 7/2008 | Baba et al. |
| 7,442,478 | B2 | 10/2008 | Itakura et al. |
| 7,452,647 | B2 | 11/2008 | Hayami et al. |
| 7,611,813 | B2 | 11/2009 | Ida et al. |
| 7,855,042 | B2 | 12/2010 | Kobori et al. |
| 7,858,283 | B2 | 12/2010 | Ishigami et al. |
| 7,875,413 | B2 | 1/2011 | Shibai et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,921,023 | B2 | 12/2014 | Baba et al. |
| 8,927,188 | B2 | 1/2015 | Naka et al. |
| 8,986,914 | B2 | 3/2015 | Fujikawa et al. |
| 9,034,549 | B2 | 5/2015 | Shiotari et al. |
| 9,057,970 | B2 | 6/2015 | Ida et al. |
| 9,058,924 | B2 | 6/2015 | Komatsu et al. |
| 9,063,443 | B2 | 6/2015 | Ishigami et al. |
| 9,152,088 | B1 | 10/2015 | Kobori et al. |
| 9,348,247 | B2 | 5/2016 | Ida et al. |
| 9,348,253 | B2 | 5/2016 | Kanno et al. |
| 9,372,420 | B2 | 6/2016 | Mizo et al. |
| 9,417,540 | B2 | 8/2016 | Hashimoto et al. |
| 9,500,975 | B2 | 11/2016 | Sugahara et al. |
| 9,540,483 | B2 | 1/2017 | Ida et al. |
| 9,594,323 | B2 | 3/2017 | Fujikawa et al. |
| 9,599,920 | B2 | 3/2017 | Sugahara et al. |
| 9,651,883 | B2 | 5/2017 | Hama et al. |
| 9,665,021 | B2 | 5/2017 | Ohtsu et al. |
| 9,665,023 | B2 | 5/2017 | Kamae et al. |
| 9,665,026 | B2 | 5/2017 | Iwasaki et al. |
| 9,671,707 | B2 | 6/2017 | Minagawa et al. |
| 9,696,644 | B2 | 7/2017 | Ida et al. |
| 9,778,598 | B2 | 10/2017 | Onozaki et al. |
| 2007/0259284 | A1 | 11/2007 | Shibai et al. |
| 2009/0246675 | A1 | 8/2009 | Nakamura et al. |
| 2009/0233212 | A1 | 9/2009 | Fujikawa et al. |
| 2010/0028796 | A1 | 2/2010 | Nakamura et al. |
| 2010/0183971 | A1 | 7/2010 | Fujikawa et al. |
| 2013/0108955 | A1 | 5/2013 | Shibata et al. |
| 2013/0244159 | A1 | 9/2013 | Ishigami et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2015/0099227 | A1 | 4/2015 | Ida et al. |
| 2016/0109820 | A1 | 4/2016 | Hashimoto et al. |
| 2016/0306301 | A1 | 10/2016 | Sugahara et al. |
| 2016/0363877 | A1 | 12/2016 | Hama et al. |
| 2017/0315461 | A1 | 11/2017 | Komatsu et al. |
| 2017/0315463 | A1 | 11/2017 | Onozaki et al. |
| 2017/0329245 | A1 | 11/2017 | Shibata et al. |
| 2017/0343911 | A1 | 11/2017 | Hashimoto et al. |
| 2017/0357168 | A1 | 12/2017 | Kanno et al. |
| 2017/0363982 | A1 | 12/2017 | Tamura et al. |

OTHER PUBLICATIONS

U.S. Appl. No. 15/693,662, Hayato Ida, filed Sep. 1, 2017.
U.S. Appl. No. 15/730,337, Tomoyo Miyakai, filed Oct. 11, 2017.
U.S. Appl. No. 15/813,713, Yuto Onozaki, filed Nov. 15, 2017.

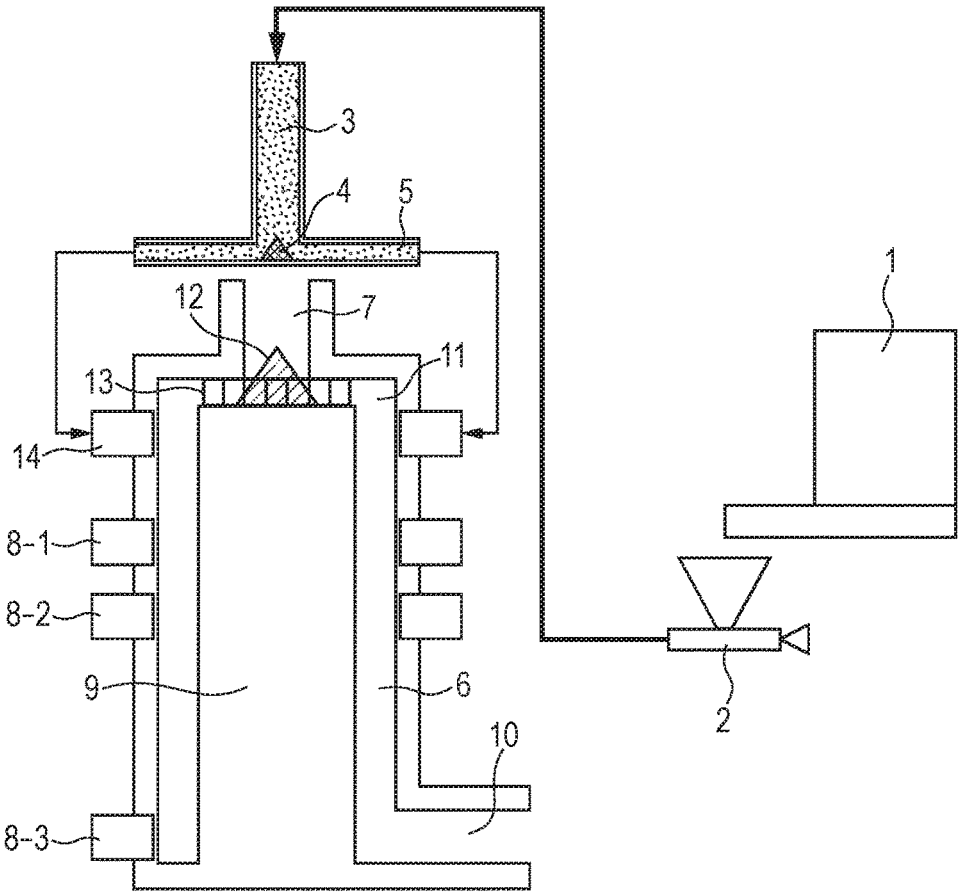
3
4
5
1
12
7
11
13
14
8-1
8-2
9
6
2
10
8-3

TONER

BACKGROUND OF THE INVENTION

Field of the Invention

The present invention relates to a toner to be used in an electrophotographic copying machine or printer.

Description of the Related Art

In recent years, an electrophotographic full-color copying machine has become widespread and its application to a printing market has started. In the printing market, the copying machine has started to be required to achieve a high speed, high image quality, and high productivity while corresponding to a wide variety of media (paper kinds).

For example, the following medium equal-speed property has been required. Even when a paper kind is changed from thick paper to thin paper, printing is continued without any change in process speed or any change in heating set temperature of a fixing unit in accordance with the paper kind. From the viewpoint of the medium equal-speed property, toner has been required to properly complete fixation in a wide fixation temperature range from low temperature to high temperature. In particular, fixation in a low-temperature region has, for example, the following large merits. A waiting time for the surface of a fixing member, such as a fixing roll, to reach a fixable temperature at the time of the turning-on of a power source, i.e., a so-called warm-up time can be shortened, and the lifetime of the fixing member can be lengthened.

In Japanese Patent Application Laid-Open No. 2006-267248, there is a proposal of the use of an ethylene-vinyl acetate resin as a method of fixing related-art toner at lower temperature. In a toner proposed in Japanese Patent Application Laid-Open No. 2006-267248, both high glossiness and low-temperature fixability are achieved by using a styrene-acrylic resin as a binder resin and incorporating the ethylene-vinyl acetate resin. The toner has a sharp melt property and is excellent in fixability. Meanwhile, however, the toner has involved a problem in that its charging stability is insufficient. For example, under a high-temperature and high-humidity environment, the styrene-acrylic resin present on the surface of the toner is liable to absorb moisture because the resin has a polar group in a molecule thereof, and the surface resistance of the toner reduces depending on the state of the moisture absorption in some cases. In such cases, there is a risk in that charge is discharged from the surface of the toner to reduce the charge quantity of the toner, and the reduction is responsible for an image failure.

In Japanese Patent Application Laid-Open No. 2000-147829, there is a proposal of the use of a cyclic polyolefin resin as a binder resin forming a toner particle for hydrophobizing the surface of a toner to improve its charging stability. The cyclic polyolefin resin has the following advantage. The resin has a low moisture-absorbing property because the resin does not have any polar group in a molecule thereof, and hence the resin shows satisfactory charging stability. Further, the cyclic polyolefin resin is suitable for the formation of a color image because its transparency is high. In addition, the glass transition temperature of the resin can be easily controlled by selecting a monomer kind thereof. As described above, the cyclic polyolefin resin has various advantages and is hence useful as a binder resin for toner. Meanwhile, however, the resin involves a problem in that its adhesiveness with paper is low.

Accordingly, an image formed with a toner containing the cyclic polyolefin resin as a binder resin has a low fixing strength on paper, and has low glossiness.

To cope with the problem, in Japanese Patent Application Laid-Open No. 2007-298869, there is a proposal of a technology concerning the fact that the use of, for example, a polyester resin as a binder resin forming a toner particle is effective in obtaining a fixed image having high glossiness and a high strength. In Japanese Patent Application Laid-Open No. 2007-298869, there is a disclosure of a toner that contains a coating layer containing a cyclic polyolefin resin and toner particles each containing a synthetic resin, such as a polyester resin, and that has a core/shell-type structure. The toner achieves a fixed image having high glossiness and a high strength despite the fact that its surface is coated with the cyclic polyolefin resin poor in fixability to paper or the like. However, an affinity between the polyester resin and the cyclic polyolefin resin is low, and hence when the toner is used for a long time period, the cyclic polyolefin resin layer may peel from the surface of the toner. In that case, an external additive of the surface of the toner desorbs together with the cyclic polyolefin resin, with the result that the flowability of the toner may deteriorate to reduce its charge quantity. Further, the binder resin having a polar group is exposed to the surface of the toner to absorb moisture under high humidity, and hence the resistance of the toner reduces in some cases. As a result, the charge quantity may reduce.

SUMMARY OF THE INVENTION

One embodiment of the present invention is directed to the provision of a toner that hardly deteriorates even when used for a long time period and that can maintain stable chargeability even under a high-humidity environment.

According to one embodiment of the present invention, there is provided a toner, including toner particles each containing an amorphous polyester resin and a wax, in which:

a surface of each of the toner particles has a coating layer;

the coating layer contains at least one kind of olefin-based copolymer selected from a group of resins each having at least a structural unit represented by the following formula (1) and a structural unit represented by the following formula (2) and/or the following formula (3); and an arithmetic average of ratios of the units represented by the formulae (2) and (3) with respect to the olefin-based copolymer is 3 mass % or more and 35 mass % or less:

Formula (1)

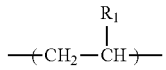

Formula (2)

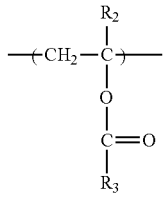

-continued

Formula (3)

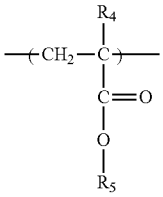

where $R_1$ represents H or $CH_3$, $R_2$ represents H or $CH_3$, $R_3$ represents $CH_3$, $C_2H_5$ or $C_3H_7$, $R_4$ represents H or $CH_3$, and $R_5$ represents $CH_3$ or $C_2H_5$.

Further features of the present invention will become apparent from the following description of exemplary embodiments with reference to the attached drawing.

BRIEF DESCRIPTION OF THE DRAWING

FIGURE is a view of a heat sphering treatment apparatus to be used in the present invention.

DESCRIPTION OF THE EMBODIMENTS

Preferred embodiments of the present invention will now be described in detail in accordance with the accompanying drawing.

Now, embodiments of the present invention are described.

<Toner>

A toner according to one embodiment of the present invention includes toner particles each containing an amorphous polyester resin and a wax. The surface of each of the toner particles has a coating layer, the coating layer contains one or more kinds of olefin-based copolymers selected from a group of resins each having at least a structural unit represented by the following formula (1) and a structural unit represented by the following formula (2) and/or the following formula (3), and the arithmetic average of ratios of the units represented by the formulae (2) and (3) with respect to the olefin-based copolymer is 3 mass % or more and 35 mass % or less:

Formula (1)

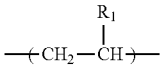

Formula (2)

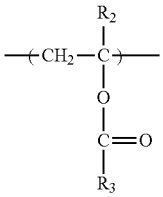

Formula (3)

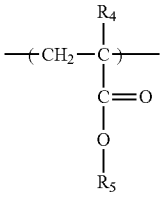

where $R_1$ represents H or $CH_3$, $R_2$ represents H or $CH_3$, $R_3$ represents $CH_3$, $C_2H_5$ or $C_3H_7$, $R_4$ represents H or $CH_3$, and $R_5$ represents $CH_3$ or $C_2H_5$.

The use of such toner as described above has led to the obtainment of a toner that does not deteriorate even when used for a long time period and that can maintain stable chargeability even under a high-humidity environment.

The inventors have considered the reason why the problems have been solved in the present invention to be as described below.

In a toner of the present invention, an amorphous polyester resin is used as a binder resin, and the surface of each of toner particles has a coating layer containing one or more kinds of olefin-based copolymers selected from a group of resins each having a structural unit represented by the formula (1) and a structural unit represented by the formula (2) and/or the formula (3).

Here, the phrase "has a coating layer" as used in the present invention refers to the case in which the following two items are satisfied in the observation of a section of each of the toner particles with a transmission electron microscope (TEM):

(1) the average layer thickness of the coating layers in the surfaces of the toner particles is 0.1 μm or more and 1.0 μm or less; and (2) the coverage of each of the toner particles with the coating layer is 90% or more.

The coating layer containing the olefin-based copolymer has an ester moiety. Accordingly, it is assumed that a n-n interaction between the ester moiety and an ester moiety of the amorphous polyester resin acts to cause the olefin-based copolymer and the polyester resin to closely adhere to each other. As a result, it is conceivable that even in a situation where the toner is exposed to mechanical stress, the coating layer hardly peels from the surface of each of the toner particles and hence a reduction in charge quantity of the toner hardly occurs.

In addition, the coating layer has a low moisture-absorbing property and is excellent in charging stability because the polarity of the olefin-based copolymer is low. When the average layer thickness of the coating layers satisfies the above-mentioned range, the coating layer is hardly influenced by the polarity of the amorphous polyester resin. Accordingly, it is conceivable that the amount of moisture to be absorbed in the surface of the toner reduces and hence a reduction in charge quantity of the toner under a high-humidity environment hardly occurs.

In addition, when the coverage of each of the toner particles with the coating layer satisfies the above-mentioned range, the ratio at which the amorphous polyester resin is exposed to the surface of the toner reduces. Accordingly, it is conceivable that the amount of moisture to be absorbed in the surface of the toner reduces and hence a reduction in charge quantity of the toner under a high-humidity environment hardly occurs.

Methods of calculating the average layer thickness of the coating layers and the coverage of each of the toner particles with the coating layer are described later.

As can be seen from the foregoing, there can be obtained a toner that does not deteriorate even when used for a long time period and that can maintain stable chargeability even under a high-humidity environment.

The coating of the surfaces of the toner particles with the olefin-based copolymer may be performed in accordance with a known method, such as an external addition method, a heat treatment method, an emulsion aggregation method, a mechanofusion method, a fluidized bed method, or a wet coating method.

In the case of the external addition method, the coating layer is desirably formed by: causing the surface of each of the toner particles to electrostatically adsorb olefin-based copolymer particles with a mixing apparatus; and then pressurizing the surface of the toner particle with mechanical impact to melt part or the total amount of the olefin-based copolymer. Examples of the mixing apparatus include MECHANO HYBRID (manufactured by Nippon Coke & Engineering Co., Ltd.), NOBILTA (manufactured by Hosokawa Micron Corporation), and a mechanofusion apparatus.

In the case of a heat treatment method, the coating layer is desirably formed by: causing the surface of each of the toner particles to electrostatically adsorb the olefin-based copolymer particles; and then melting part or the total amount of the olefin-based copolymer through heat treatment.

In the case of the fluidized bed method, the toner is produced by: forming the fluidized bed of the toner particles; applying an olefin-based copolymer solution or the olefin-based copolymer particles to the fluidized bed by spraying; and drying a solvent in the solution to form the coating layer. For example, a particle coating-granulation apparatus SFP (manufactured by Powrex Corporation) may be utilized for performing the fluidized bed method.

In the case of the wet coating method, the coating layer is formed by: impregnating the toner particles with the olefin-based copolymer solution; and mixing, stirring, and drying the particles with a screw. For example, a Nauta mixer may be utilized for performing the wet coating method. In addition, in the case of a seed method (emulsion polymerization method), the coating layer can be formed by: adding an olefin monomer solution to a toner particle-dispersed liquid; and polymerizing an olefin monomer on the surface of each of the toner particles. In addition, in the case of the emulsion aggregation method, the coating layer can be formed by: adding an olefin-based copolymer particle-dispersed liquid to the toner particle-dispersed liquid; and causing the copolymer particles to adhere to the surface of each of the toner particles. The resultant toner can be easily isolated from a reaction system by a general isolation purification method, such as filtration, washing with pure water, or vacuum drying.

The toner of the present invention is preferably produced through a step of thermally treating the toner particles after their surfaces have been coated with the olefin-based copolymer. The inventors have considered the reason for the foregoing to be as described below. When the toner coated with the olefin-based copolymer is thermally treated, it is conceivable that the respective ester moieties of the olefin-based copolymer and the amorphous polyester resin are oriented, and hence a n-n interaction acts more significantly therebetween. The olefin-based copolymer and the amorphous polyester resin attract each other, and hence it is assumed that even in a situation where the toner is exposed to mechanical stress, the desorption of the olefin-based copolymer from the surface of the toner hardly occurs. As a result, the desorption of an external additive does not occur and hence the flowability of the toner is maintained. Thus, a reduction in charge quantity of the toner hardly occurs. In addition, a state in which the amorphous polyester resin is not present on the surface of the toner can be maintained. Accordingly, the inventors have considered that a change in resistance characteristic of the toner resulting from a state in which water adsorbs to the amorphous polyester resin is small, and hence the toner does not cause any fluctuation in charge quantity even when used for a long time period, and an image failure hardly occurs.

An amorphous resin (binder resin) to be used in the present invention contains a polyester resin as a main component.

A polyhydric alcohol (dihydric or trihydric or higher alcohol) and a polyvalent carboxylic acid (divalent or trivalent or higher carboxylic acid), or an acid anhydride or lower alkyl ester thereof are used as monomers to be used in the polyester unit of the polyester resin. Here, partial cross-linking in a molecule of the binder resin is effective in producing a branched polymer. To that end, a trivalent or higher polyfunctional compound is preferably used. Therefore, a trivalent or higher carboxylic acid, or an acid anhydride or lower alkyl ester thereof, and/or a trihydric or higher alcohol is preferably incorporated as a raw material monomer for the polyester unit.

The following polyhydric alcohol monomers may each be used as a polyhydric alcohol monomer to be used in the polyester unit of the polyester resin.

As a dihydric alcohol component, there are given, for example, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a bisphenol represented by the formula (A) and derivatives thereof:

(A)

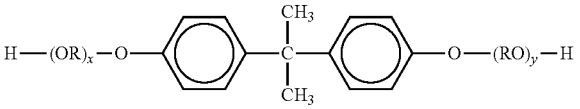

where R represents an ethylene or propylene group, x and y each represent an integer of 0 or more, and the average of x+y is 0 or more and 10 or less, and a diol represented by the formula (B):

(B)

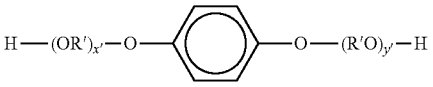

where R' represents —$CH_2$—$CH_2$—, —$CH_2$—$CH(CH_3)$—, or —$CH_2$—$C(CH_3)_2$—, x' and y' each represent an integer of 0 or more, and the average of x'+y' is 0 or more and 10 or less.

As a trihydric or higher alcohol component, there are given, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Of those, glycerol, trimethylolpropane, and pentaerythritol are preferably used. Those dihydric alcohols and trihydric or higher alcohols may be used alone or in combination thereof.

The following polyvalent carboxylic acid monomers may each be used as a polyvalent carboxylic acid monomer to be used in the polyester unit of the polyester resin.

As a divalent carboxylic acid component, there are given, for example, maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, and isooctylsuccinic acid, and anhydrides of those acids and lower alkyl esters thereof. Of those, maleic acid, fumaric acid, terephthalic acid, and n-dodecenylsuccinic acid are preferably used.

Examples of the trivalent or higher carboxylic acid, or the acid anhydride or lower alkyl ester thereof include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, EMPOL trimer acid, and acid anhydrides thereof or lower alkyl esters thereof. Of those, 1,2,4-benzenetricarboxylic acid, i.e., trimellitic acid or a derivative thereof is particularly preferably used because trimellitic acid or the derivative thereof is available at low cost and its reaction can be easily controlled. The divalent carboxylic acids and the like, and the trivalent or higher carboxylic acids described above may be used alone or in combination thereof.

The binder resin may be a hybrid resin containing any other resin component as long as the resin contains the polyester resin as a main component. An example thereof is a hybrid resin of the polyester resin and a vinyl-based resin. A method of obtaining a product of a reaction between the vinyl-based resin or a vinyl-based copolymerization unit and the polyester resin like the hybrid resin is preferably a method involving performing, in the presence of a polymer containing a monomer component that can react with each of the vinyl-based resin or the vinyl-based copolymerization unit and the polyester resin, the polymerization reaction of one, or each of both, of the resins.

Of the monomers each forming the polyester resin component, the monomer that can react with the vinyl-based copolymer is, for example, an unsaturated dicarboxylic acid, such as fumaric acid, maleic acid, citraconic acid, or itaconic acid, or an anhydride thereof. Of the monomers each forming the vinyl-based copolymer component, the monomer that can react with the polyester resin component is, for example, a monomer having a carboxyl group or a hydroxy group, or an acrylic acid or methacrylic acid ester.

In addition, in the present invention, as the binder resin, various resin compounds that have heretofore been known as binder resins as well as the above-mentioned vinyl-based resins may each be used in combination as long as the resin contains the polyester resin as a main component. Examples of such resin compounds include a phenol resin, a natural resin-modified phenol resin, a natural resin-modified maleic resin, an acrylic resin, a methacrylic resin, a polyvinyl acetate resin, a silicone resin, a polyester resin, polyurethane, a polyamide resin, a furan resin, an epoxy resin, a xylene resin, polyvinyl butyral, a terpene resin, a coumarone-indene resin, and a petroleum-based resin.

In addition, the acid value of the binder resin of the present invention is preferably 15 mgKOH/g or more and 30 mgKOH/g or less from the viewpoint of charging stability under a high-temperature and high-humidity environment. Further, the hydroxyl value of the binder resin of the present invention is preferably 2 mgKOH/g or more and 20 mgKOH/g or less from the viewpoints of low-temperature fixability and storage stability.

In addition, a mixture of a binder resin B having a low molecular weight and a binder resin A having a high molecular weight may be used as the binder resin of the present invention. The content ratio (A/B) of the binder resin A having a high molecular weight to the binder resin B having a low molecular weight is preferably 10/90 or more and 60/40 or less on a mass basis from the viewpoints of low-temperature fixability and hot offset resistance.

The peak molecular weight of the binder resin A having a high molecular weight is preferably 10,000 or more and 20,000 or less from the viewpoint of hot offset resistance. In addition, the acid value of the binder resin A having a high molecular weight is preferably 15 mgKOH/g or more and 30 mgKOH/g or less from the viewpoint of charging stability under a high-temperature and high-humidity environment.

The number-average molecular weight of the binder resin B having a low molecular weight is preferably 1,500 or more and 3,500 or less from the viewpoint of low-temperature fixability. In addition, the acid value of the binder resin B having a low molecular weight is preferably 10 mgKOH/g or less from the viewpoint of charging stability under a high-temperature and high-humidity environment.

In the present invention, examples of the olefin-based copolymer include: an ethylene-vinyl acetate copolymer having the units represented by the formula (1) and the formula (2) in which $R_1$ represents H, $R_2$ represents H, and $R_3$ represents $CH_3$; an ethylene-methyl acrylate copolymer having the units represented by the formula (1) and the formula (3) in which $R_1$ represents H, $R_4$ represents H, and $R_5$ represents $CH_3$; an ethylene-ethyl acrylate copolymer having the units represented by the formula (1) and the formula (3) in which $R_1$ represents H, $R_4$ represents H, and $R_5$ represents $C_2H_5$; and an ethylene-methyl methacrylate copolymer having the units represented by the formula (1) and the formula (3) in which $R_1$ represents H, $R_4$ represents $CH_3$, and $R_5$ represents $CH_3$.

The olefin-based copolymer is preferably an ethylene-vinyl acetate copolymer from the following viewpoint: even when its ester group concentration is low, the copolymer has a low melting point, and hence can easily achieve both low-temperature fixability and charge retentivity. The copolymer is preferably an acrylate copolymer, such as an ethylene-ethyl acrylate copolymer or an ethylene-methyl acrylate copolymer, or an ethylene-methyl methacrylate copolymer, from the viewpoint that the acrylate copolymer has high chemical stability, and hence has high storage stability under high temperature and high humidity.

One or more kinds of the olefin-based copolymers may be incorporated into the binder resin.

When the total sum of the masses of the olefin-based copolymers is represented by W, and the masses of the units represented by the formula (1), the formula (2), and the formula (3) are represented by 1, m, and n, respectively, the weighted average of the ratios (l+m+n)/W of the olefin-based copolymers to be incorporated into the binder resin is preferably 0.80 or more from the viewpoints of low-temperature fixability and charge retentivity, and is more preferably 0.95 or more. When the plurality of olefin-based copolymers are incorporated into the binder resin, the expression "weighted average of the ratios (l+m+n)/W" as used herein means the weighted average of the ratios (l+m+n)/W of the respective olefin-based copolymers and the component ratios of the respective olefin-based copolymers with respect to the total amount of the olefin-based copolymers. When one kind of the olefin-based copolymer is incorporated into the binder resin, its ratio (l+m+n)/W itself is applied.

Examples of a unit except the units represented by the formula (1), the formula (2), and the formula (3) that may be incorporated into the olefin-based copolymer include a unit represented by the formula (4) and a unit represented by the formula (5). Those units may each be introduced by, for example, adding a corresponding monomer at the time of a copolymerization reaction for the production of the olefin-based ester group-containing copolymer or modifying the olefin-based ester group-containing copolymer through a polymer reaction.

Formula (4)

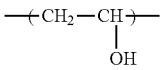

Formula (5)

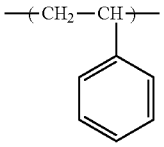

The content of the olefin-based copolymer is preferably 1 part by mass or more and 40 parts by mass or less with respect to 100 parts by mass of the toner particles.

The arithmetic average of the ratios of the units represented by the formulae (2) and (3) of the olefin-based copolymer needs to be 3 mass % or more and 35 mass % or less, and is preferably 5 mass % or more and 20 mass % or less. When the arithmetic average of the ratios of the units represented by the formulae (2) and (3) of the olefin-based copolymer is 35 mass % or less, the charge retentivity of the toner is improved, and when the arithmetic average is 20 mass % or less, the charge retentivity is further improved. Meanwhile, when the arithmetic average of the ratios of the units represented by the formulae (2) and (3) of the olefin-based copolymer is 3 mass % or more, the adhesiveness of the toner with paper and the low-temperature fixability thereof are improved, and when the arithmetic average is 5 mass % or more, the adhesiveness and the low-temperature fixability are further improved.

With regard to the molecular weight of the olefin-based copolymer, its weight-average molecular weight is preferably 50,000 or more, more preferably 100,000 or more. In addition, the molecular weight of the olefin-based copolymer is preferably 500,000 or less from the viewpoint of the glossiness of an image.

A crystalline polyester may be incorporated into the toner of the present invention as required. The crystalline polyester to be used in the present invention is obtained by subjecting an aliphatic diol having 6 or more and 12 or less carbon atoms, and an aliphatic dicarboxylic acid having 6 or more and 12 or less carbon atoms to condensation polymerization.

The inventors have considered the reason why the use of the crystalline polyester improves the low-temperature fixability of the toner to be as follows: the binder resin and the crystalline polyester are made compatible with each other to widen an interval between the molecular chains of the binder resin, and hence an intermolecular force therebetween is weakened. Thus, the glass transition temperature (Tg) of the toner significantly reduces, and hence a state in which the melt viscosity thereof is low can be established. Accordingly, it is conceivable that the low-temperature fixability is improved by improving compatibility between the binder resin and the crystalline polyester.

In order to improve the compatibility between the binder resin and the crystalline polyester, it is preferred that the number of carbon atoms of the aliphatic diol and/or the aliphatic dicarboxylic acid serving as a monomer forming the crystalline polyester be reduced, and the ester group concentration of the crystalline polyester be increased to improve the polarity thereof.

Meanwhile, with regard to a toner whose Tg has significantly reduced, the exudation of its crystalline polyester to the surface of the toner needs to be suppressed even under mechanical stress or under a high-temperature and high-humidity environment. When the toner is exposed to such environment, the Tg of the toner needs to be returned to the Tg of its binder resin by recrystallizing the crystalline polyester in the toner that has been made compatible with the binder resin. Here, when the ester group concentration of the crystalline polyester is high, and hence the compatibility between the binder resin and the crystalline polyester is excessively high, it becomes difficult to recrystallize the crystalline polyester, and hence the exudation to the surface of the toner worsens to advance member contamination, such as filming. In view of the foregoing, the aliphatic diol having 6 or more and 12 or less carbon atoms, and the aliphatic dicarboxylic acid having 6 or more and 12 or less carbon atoms are used as monomer components for the crystalline polyester that can achieve both low-temperature fixability and exudation resistance.

The content of the crystalline polyester to be used in the present invention is 1 part by mass or more and 15 parts by mass or less with respect to 100 parts by mass of the amorphous polyester resin. When the content of the crystalline polyester is 1 part by mass or more, the low-temperature fixability of the toner is improved. In addition, when the content is 15 parts by mass or less, the crystalline polyester can be finely dispersed in the toner, and the low-temperature fixability is maintained.

<Wax>

Examples of the wax to be used in the toner of the present invention include: a hydrocarbon-based wax, such as low-molecular-weight polyethylene, low-molecular-weight polypropylene, an alkylene copolymer, microcrystalline wax, paraffin wax, or Fischer-Tropsch wax; an oxide of a hydrocarbon-based wax, such as oxidized polyethylene wax, or a block copolymerization product thereof; a wax containing a fatty acid ester as a main component, such as carnauba wax; and a wax obtained by subjecting part or all of fatty acid esters to deacidification, such as deacidified carnauba wax. Further examples thereof include: a saturated linear fatty acid, such as palmitic acid, stearic acid, or montanic acid; a unsaturated fatty acid, such as brassidic acid, eleostearic acid, or parinaric acid; a saturated alcohol, such as stearyl alcohol, an aralkyl alcohol, behenyl alcohol, carnaubyl alcohol, ceryl alcohol, or melissyl alcohol; a polyhydric alcohol, such as sorbitol; an ester formed of a fatty acid, such as palmitic acid, stearic acid, behenic acid, or montanic acid, and an alcohol, such as stearyl alcohol, an aralkyl alcohol, behenyl alcohol, carnaubyl alcohol, ceryl alcohol, or melissyl alcohol; a fatty acid amide, such as linoleamide, oleamide, or lauramide; a saturated fatty acid bisamide, such as methylenebisstearamide, ethylenebiscapramide, ethylenebislauramide, or hexamethylenebisstearamide; an unsaturated fatty acid amide, such as ethylenebisoleamide, hexamethylenebisoleamide, N,N'-dioleyladipamide, or N,N'-dioleylsebacamide; an aromatic bisamide, such as m-xylenebisstearamide or N,N'-distearylisophthalamide; an aliphatic metal salt, such as calcium stearate, calcium laurate, zinc stearate, or magnesium stearate (generally referred to as metal soap); a wax obtained by grafting an aliphatic hydrocarbon-based wax with a vinyl-based monomer, such as styrene or acrylic acid; a partially esterified product formed of a fatty acid and a polyhydric alcohol, such as behenic acid monoglyceride; and a methyl ester compound having a hydroxyl group obtained by subjecting a vegetable oil to hydrogenation.

Of those waxes, a hydrocarbon-based wax, such as paraffin wax or Fischer-Tropsch wax, or a fatty acid ester-based wax, such as carnauba wax, is preferred from the viewpoint of improving low-temperature fixability and hot offset resistance. In the present invention, a hydrocarbon-based wax is more preferred from the viewpoint of further improving hot offset resistance.

In the present invention, the wax is preferably used in an amount of 1 part by mass or more and 20 parts by mass or less with respect to 100 parts by mass of the binder resin.

In addition, in an endothermic curve measured with a differential scanning calorimetry (DSC) apparatus at the time of temperature increase, the peak temperature of the highest endothermic peak of the wax is preferably 45° C. or more and 140° C. or less. The peak temperature of the highest endothermic peak of the wax preferably falls within the range because both the storage stability and hot offset resistance of the toner can be achieved.

<Colorant>

As a colorant that may be incorporated into the toner, there are given, for example, the following colorants.

As a black colorant, there are given, for example: carbon black; and a colorant toned to a black color with a yellow colorant, a magenta colorant, and a cyan colorant. Although a pigment may be used alone as the colorant, a dye and the pigment are more preferably used in combination to improve the clarity of the colorant in terms of the quality of a full-color image.

As a pigment for magenta toner, there are given, for example: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, or 282; C.I. Pigment Violet 19; and C.I. Vat Red 1, 2, 10, 13, 15, 23, 29, or 35.

As a dye for magenta toner, there are given, for example: oil-soluble dyes, such as: C.I. Solvent Red 1, 3, 8, 23, 24, 25, 27, 30, 49, 81, 82, 83, 84, 100, 109, or 121; C.I. Disperse Red 9; C.I. Solvent Violet 8, 13, 14, 21, or 27; and C.I. Disperse Violet 1; and basic dyes, such as: C.I. Basic Red 1, 2, 9, 12, 13, 14, 15, 17, 18, 22, 23, 24, 27, 29, 32, 34, 35, 36, 37, 38, 39, or 40; and C.I. Basic Violet 1, 3, 7, 10, 14, 15, 21, 25, 26, 27, or 28.

As a pigment for cyan toner, there are given, for example: C.I. Pigment Blue 2, 3, 15:2, 15:3, 15:4, 16, or 17; C.I. Vat Blue 6; C.I. Acid Blue 45; and a copper phthalocyanine pigment in which a phthalocyanine skeleton is substituted by 1 to 5 phthalimidomethyl groups.

For example, C.I. Solvent Blue 70 is given as a dye for cyan toner.

As a pigment for yellow toner, there are given, for example: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; and C.I. Vat Yellow 1, 3, or 20.

For example, C.I. Solvent Yellow 162 is given as a dye for yellow toner.

The colorant is preferably used in an amount of 0.1 part by mass or more and 30 parts by mass or less with respect to 100 parts by mass of the binder resin.

<Charge Control Agent>

A charge control agent may be incorporated into the toner as required. A known charge control agent may be utilized as the charge control agent to be incorporated into the toner. In particular, a metal compound of an aromatic carboxylic acid, which is colorless, provides a high charging speed of the toner, and can stably maintain a constant charge quantity, is preferred.

As a negative charge control agent, there are given a metal salicylate compound, a metal naphthoate compound, a metal dicarboxylate compound, a polymeric compound having a sulfonic acid or a carboxylic acid in a side chain thereof, a polymeric compound having a sulfonic acid salt or a sulfonic acid ester in a side chain thereof, a polymeric compound having a carboxylic acid salt or a carboxylic acid ester in a side chain thereof, a boron compound, a urea compound, a silicon compound, and a calixarene. As a positive charge control agent, there are given a quaternary ammonium salt, a polymeric compound having the quaternary ammonium salt in a side chain thereof, a guanidine compound, and an imidazole compound. The charge control agent may be internally added to each toner particle, or may be externally added thereto. The charge control agent is preferably added in an amount of 0.2 part by mass or more and 10 parts by mass or less with respect to 100 parts by mass of the binder resin.

<Inorganic Fine Particles>

Inorganic fine particles may be incorporated into the toner of the present invention as required. The inorganic fine particles may be internally added to the toner particles, or may be mixed as an external additive with the toner particles. The external additive is preferably inorganic fine powder, such as silica, titanium oxide, or aluminum oxide. The inorganic fine powder is preferably hydrophobized with a hydrophobizing agent, such as a silane compound, a silicone oil, or a mixture thereof.

An external additive for improving the flowability is preferably inorganic fine powder having a specific surface area of 50 $m^2/g$ or more and 400 $m^2/g$ or less. An external additive for improving the durability is preferably inorganic fine powder having a specific surface area of 10 $m^2/g$ or more and 50 $m^2/g$ or less. Inorganic fine powder having a specific surface area that falls within the ranges may be used in combination in order that both the flowability improvement and the durability improvement may be achieved.

The external additive is preferably used in an amount of 0.1 part by mass or more and 10.0 parts by mass or less with respect to 100 parts by mass of the toner particles. The toner particles and the external additive may be mixed with a known mixer, such as a Henschel mixer.

<Developer>

The toner of the present invention may be used as a one-component developer, but is preferably mixed with a magnetic carrier and used as a toner for a two-component developer in order that dot reproducibility may be further improved and from the viewpoint that a stable image may be obtained over a long time period.

A generally known carrier may be used as the magnetic carrier, and examples thereof include: magnetic materials, such as surface-oxidized iron powder or unoxidized iron powder, metal particles, such as iron, lithium, calcium, magnesium, nickel, copper, zinc, cobalt, manganese, chromium, and rare earths, and alloy particles, oxide particles, and ferrites thereof; and a magnetic material-dispersed resin carrier (the so-called resin carrier) containing a magnetic material and a binder resin holding the magnetic material under a state in which the magnetic material is dispersed therein.

In the case where the toner of the present invention is mixed with the magnetic carrier and used as a two-component developer, a satisfactory result is generally obtained when the mixing ratio of the carrier in that case is set to 2 mass % or more and 15 mass % or less, preferably 4 mass % or more and 13 mass % or less in terms of a toner concentration in the two-component developer.

<Production Method>

Although a method of producing the toner of the present invention is not particularly limited as long as the method is a conventionally known toner production method, such as a melt-kneading method, an emulsion aggregation method, or a solution suspension method, the melt-kneading method is preferred from the viewpoint of the dispersibility of each of raw materials for the toner.

When the toner of the present invention is produced through a melt-kneading step, the dispersibility of each of the wax and the amorphous polyester resin is improved. This is probably because of the following reason: in the toner produced by the melt-kneading method, the raw materials for the toner are sufficiently mixed by heat and shear at the time of their kneading, and hence when the toner is obtained, the dispersibility of each of the wax and the amorphous polyester resin in the toner is improved. As a result, the wax in the toner is finely dispersed, and hence its hot offset resistance is improved. In addition, the exudation of the wax or the amorphous polyester resin to the surface of the toner under a mechanically stressed environment or under a high-temperature and high-humidity environment is suppressed, and hence the toner is excellent in durability.

Description is given by taking an example of the production method.

In a raw material-mixing step, predetermined amounts of, for example, the polyester resin, the wax, and any other component, such as the colorant, as materials forming the toner particles are weighed, and the materials are blended and mixed. A mixing apparatus is, for example, a double cone mixer, a V-type mixer, a drum-type mixer, a super mixer, a Henschel mixer, a Nauta mixer, or MECHANO HYBRID (manufactured by Nippon Coke & Engineering Co., Ltd.).

Next, the mixed materials are melt-kneaded to disperse other raw materials and the like in the binder resin. In the melt-kneading step, a batch-type kneader, such as a pressure kneader or a Banbury mixer, or a continuous kneader may be used, and a single-screw or twin-screw extruder has been in the mainstream because of the following superiority: the extruder can perform continuous production. Examples of the extruder include a KTK-type twin-screw extruder (manufactured by Kobe Steel, Ltd.), a TEM-type twin-screw extruder (manufactured by Toshiba Machine Co., Ltd.), a PCM kneader (manufactured by Ikegai Corp), a twin-screw extruder (manufactured by K.C.K.), a co-kneader (manufactured by Buss), and KNEADEX (manufactured by Nippon Coke & Engineering Co., Ltd.). Further, the resin composition obtained by the melt-kneading may be rolled with a twin-roll mill or the like, and may be cooled with water or the like in a cooling step.

Next, the cooled resin composition is pulverized in a pulverization step until a desired particle diameter is attained. In the pulverization step, the composition is coarsely pulverized with, for example, a pulverizer, such as a crusher, a hammer mill, or a feather mill, and then finely pulverized with, for example, Kryptron System (manufactured by Kawasaki Heavy Industries, Ltd.), SUPER ROTOR (manufactured by Nisshin Engineering Inc.), Turbo Mill (manufactured by Freund-Turbo Corporation), or a fine pulverizer using an air jet system.

After that, the resultant is subjected to classification with a classifier or sieving machine, such as Elbow-Jet of an inertial classification system (manufactured by Nittetsu Mining Co., Ltd.), Turboplex of a centrifugal classification system (manufactured by Hosokawa Micron Corporation), TSP Separator (manufactured by Hosokawa Micron Corporation), or Faculty (manufactured by Hosokawa Micron) as required. Thus, the toner particles are obtained.

The emulsion aggregation method serving as another production method is described.

The emulsion aggregation method is a production method involving: preparing resin fine particles that are sufficiently small as compared to a target particle diameter in advance; and aggregating the resin fine particles in an aqueous medium to produce core particles. In the emulsion aggregation method, the toner particles are produced through a step of emulsifying the resin fine particles, an aggregating step, a fusing step, a cooling step, and a washing step. In addition, a core-shell toner may be obtained by adding a shelling step after the cooling step as required.

<Step of Emulsifying Resin Fine Particles>

The resin fine particles each containing a polyester resin as a main component may be prepared by a known method. For example, a resin particle-dispersed liquid may be produced by: dissolving the resin in an organic solvent; adding the solution to the aqueous medium; dispersing the particles of the resin in the aqueous medium with a dispersing machine, such as a homogenizer, together with a surfactant or a polymer electrolyte; and then performing heating or a pressure reduction to remove the solvent. Although any solvent may be used as the organic solvent to be used for dissolving the resin as long as the solvent dissolves the resin, tetrahydrofuran, ethyl acetate, chloroform, or the like is preferred from the viewpoint of solubility.

In addition, in terms of an environmental load, it is preferred that the resin and the surfactant, a base, or the like be added to an aqueous medium substantially free of any organic solvent, and be emulsified and dispersed in the aqueous medium with a dispersing machine configured to apply a high-speed shear force, such as CLEARMIX, a homomixer, or a homogenizer. In particular, the content of an organic solvent having a boiling point of 100° C. or less is preferably 100 μg/g or less. When the content deviates from the range, a step of removing and collecting the organic solvent is newly needed at the time of the production of the toner, and hence measures for waste water treatment are required. The content of the organic solvent in the aqueous medium may be measured by using gas chromatography (GC).

Although the surfactant to be used at the time of the emulsification is not particularly limited, examples thereof include: anionic surfactants, such as sulfate-, sulfonate-, carboxylate-, phosphate-, and soap-based surfactants; cationic surfactants, such as an amine salt- and quaternary ammonium salt-type surfactants; and nonionic surfactants, such as polyethylene glycol-, alkylphenol-ethylene oxide adduct-, and polyhydric alcohol-based surfactants. The surfactants may be used alone or in combination thereof.

The median diameter on a volume basis of the resin fine particles is preferably 0.05 μm or more and 1.0 μm or less, more preferably 0.05 μm or more and 0.4 μm or less. When the median diameter is more than 1.0 μm, it becomes difficult to obtain toner particles having a median diameter on a volume basis of 4.0 μm or more and 7.0 μm or less, which is a median diameter on a volume basis proper for toner particles. The median diameter on a volume basis may be measured with a dynamic light scattering-type particle size distribution meter (NANOTRAC UPA-EX150: manufactured by Nikkiso Co., Ltd.).

<Aggregating Step>

The aggregating step is a step of mixing the resin fine particles described above, coloring material fine particles, and release agent fine particles in accordance with their required amounts to prepare a mixed liquid, followed by the aggregation of the particles in the prepared mixed liquid to form aggregates. A method involving adding and mixing an aggregating agent in the mixed liquid, and appropriately applying temperature, mechanical power, or the like to the resultant may be suitably given as an example of a method of forming the aggregates.

Examples of the aggregating agent include: metal salts of monovalent metals, such as sodium and potassium; metal salts of divalent metals, such as calcium and magnesium; and metal salts of trivalent metals, such as iron and aluminum.

The addition and mixing of the aggregating agent are preferably performed at a temperature equal to or less than the glass transition temperature (Tg) of each of the resin fine particles in the mixed liquid. When the mixing is performed under the temperature condition, the aggregation advances in a stable state. The mixing may be performed with a known mixing apparatus, homogenizer, mixer, or the like.

Although the weight-average particle diameter of the aggregates to be formed here is not particularly limited, in ordinary cases, the weight-average particle diameter is desirably controlled to 4.0 μm or more and 7.0 μm or less so as to be comparable to the weight-average particle diameter of toner particles to be obtained. The control may be easily performed by, for example, appropriately setting and changing the temperature at the time of the addition and mixing of the aggregating agent and the like, and a condition for the stirring and mixing. The particle size distribution of the toner particles may be measured with a particle size distribution analyzer based on a Coulter method (COULTER MULTISIZER III: manufactured by Beckman Coulter, Inc.).

<Fusing Step>

The fusing step is a step of heating the aggregates to a temperature equal to or more than the glass transition temperature (Tg) of the resin to fuse the aggregates to produce such particles that the surfaces of the aggregates are smoothened. Before a primary fusing step is performed, a chelating agent, a pH adjustor, a surfactant, or the like may be appropriately loaded for preventing the melt adhesion of the toner particles.

Examples of the chelating agent include ethylenediaminetetraacetic acid (EDTA) and alkali metal salts thereof, such as a Na salt thereof, sodium gluconate, sodium tartrate, potassium citrate and sodium citrate, nitrotriacetate (NTA) salts, and various water-soluble polymers (polymer electrolytes) having both functionalities of COOH and OH.

The temperature at which the heating is performed only needs to fall within the range of from the glass transition temperature (Tg) of the resin in each of the aggregates to the temperature at which the resin thermally decomposes. A time period for the heating and the fusion may be shortened when the heating temperature is high, but the time period needs to be lengthened when the heating temperature is low. That is, the time period for the heating and the fusion cannot be unconditionally specified because the time period depends on the heating temperature, but the time period is generally from 10 minutes to 10 hours.

<Cooling Step>

The cooling step is a step of cooling the temperature of the aqueous medium containing the particles to a temperature lower than the glass transition temperature (Tg) of the resin for a core. Unless the temperature of the aqueous medium is cooled to the temperature lower than the Tg, coarse particles occur. A specific cooling rate is 0.1° C./min or more and 50° C./min or less.

<Coating Step>

In addition, in the present invention, a coating step is provided before the following washing-drying step. The coating step is a step of newly adding resin fine particles to the particles produced through the above-mentioned steps to cause the resin fine particles to adhere to the particles to coat the particles.

In the present invention, the coating layer contains one or more kinds of olefin-based copolymers selected from a group of resins each having a structural unit represented by the formula (1) and a structural unit represented by the formula (2) and/or the formula (3).

The coating layer containing the olefin-based copolymer has an ester moiety. Accordingly, it is assumed that a Π-Π interaction between the ester moiety and an ester moiety of the amorphous polyester resin acts to cause the olefin-based copolymer and the polyester resin to closely adhere to each other. As a result, it is conceivable that even in a situation where the toner is exposed to mechanical stress, the coating layer hardly peels from the surface of each of the toner particles and hence a reduction in charge quantity of the toner hardly occurs.

In addition, the coating layer has a low moisture-absorbing property and is excellent in charging stability because the polarity of the olefin-based copolymer is low.

<Washing-Drying Step>

The particles produced through the above-mentioned steps are washed and filtered with ion-exchanged water whose pH has been adjusted with sodium hydroxide or potassium hydroxide, and are subsequently washed and filtered with ion-exchanged water a plurality of times. After that, the particles are dried. Thus, emulsion aggregation toner particles can be obtained.

In addition, in the present invention, the following heat treatment step is preferably performed as required: an additive, such as inorganic fine powder or resin particles, is added to the surfaces of the toner particles obtained by the above-mentioned production method, the additive is mixed and dispersed in the toner particles, and the additive is stuck to the surfaces of the toner particles by surface treatment with hot air in the dispersed state.

For example, the toner may be obtained by performing the surface treatment with hot air through the use of a surface treatment apparatus illustrated in FIGURE and performing classification as required.

A mixture supplied in a constant amount by a raw material constant amount supply unit 1 is introduced into an introduction pipe 3 placed on the vertical line of the raw material supply unit by a compressed gas adjusted by a compressed gas-adjusting unit 2. The mixture that has passed the introduction pipe is uniformly dispersed by a conical protruded member 4 arranged at the central portion of the raw material supply unit, is introduced into supply pipes 5 radially extending in eight directions, and is introduced into a treatment chamber 6 where heat treatment is performed.

At this time, the flow of the mixture supplied to the treatment chamber is regulated by a regulating unit 9 for regulating the flow of a mixture, the unit being provided in the treatment chamber. Accordingly, the mixture supplied to the treatment chamber is subjected to the heat treatment while swirling in the treatment chamber, and then the mixture is cooled.

Hot air for thermally treating the supplied mixture is supplied from a hot air supply unit 7 and is distributed by a distribution member 12, and the hot air is spirally swirled by a swirling member 13 for swirling the hot air to be introduced into the treatment chamber. With regard to the construction of the swirling member 13 for swirling the hot air, the member has a plurality of blades, and can control the swirl of the hot air depending on the number of, and an angle between, the blades. The temperature of the hot air to be supplied into the treatment chamber at the outlet portion of the hot air supply unit 7 is preferably 100° C. or more and 300° C. or less, more preferably 130° C. or more and 170° C. or less. When the temperature at the outlet portion of the hot air supply unit falls within the range, the toner particles can be uniformly subjected to spheroidizing treatment while the fusion and coalescence of the toner particles due to excessive heating of the mixture are prevented. The hot air is supplied from an outlet 11 of the hot air supply unit.

Further, the thermally treated toner particles that have been subjected to the heat treatment are cooled by cold air supplied from a cold air supply unit 8. The temperature of the cold air supplied from the cold air supply unit 8 is preferably from −20° C. to 30° C. When the temperature of the cold air falls within the range, the thermally treated toner particles can be efficiently cooled, and the fusion and coalescence of the thermally treated toner particles can be prevented without the inhibition of the uniform spheroidizing treatment for the mixture. The absolute water content of the cold air is preferably 0.5 $g/m^3$ or more and 15.0 $g/m^3$ or less.

Next, the thermally treated toner particles that have been cooled are recovered by a recovery unit 10 positioned at the lower end of the treatment chamber. The configuration of the recovery unit is as follows: a blower (not shown) is arranged at the tip of the unit, and the particles are sucked and conveyed by the blower.

In addition, a powder particle supply port 14 is arranged so that the swirling direction of the supplied mixture and the swirling direction of the hot air may be identical to each other, and the recovery unit 10 of the surface treatment apparatus is arranged on the outer peripheral portion of the treatment chamber so that the swirling direction of a swirled powder particle may be maintained. Further, the cold air supplied from the cold air supply unit 8 is configured so as to be supplied from the outer peripheral portion of the apparatus to the inner peripheral surface of the treatment chamber from horizontal and tangential directions. The swirling direction of the toner particles before heat treatment to be supplied from the powder particle supply port, the swirling direction of the cold air supplied from the cold air supply unit, and the swirling direction of the hot air supplied from the hot air supply unit are identical to one another. Accordingly, no turbulence occurs in the treatment chamber, a swirl flow in the apparatus is strengthened, a strong centrifugal force is applied to the toner particles before heat treatment, and the dispersibility of the toner particles before heat treatment is further improved, and hence toner particles before heat treatment having a small number of coalesced particles and having a uniform shape can be obtained.

After that, an external additive, such as inorganic fine powder or resin particles, selected as required may be added and mixed and the other inorganic fine particles may be externally added to impart flowability and improve charging stability. A mixing apparatus is, for example, a double cone mixer, a V-type mixer, a drum-type mixer, a super mixer, a Henschel mixer, a Nauta mixer, or MECHANO HYBRID (manufactured by Nippon Coke & Engineering Co., Ltd.).

Next, methods of measuring respective physical properties related to the present invention are described.

Methods of measuring the various physical properties of the toner and the raw materials therefor are described below.

<Measurement of Glass Transition Temperature (Tg) of Resin>

The glass transition temperature of the resin is measured with a differential scanning calorimeter "Q2000" (manufactured by TA Instruments) in conformity with ASTM D3418-82.

The melting points of indium and zinc are used for the temperature correction of the detecting portion of the apparatus, and the heat of fusion of indium is used for the correction of a heat quantity.

Specifically, about 5 mg of the resin is precisely weighed and loaded into a pan made of aluminum, and then measurement is performed by using an empty pan made of aluminum as a reference in the measuring range of from 30° C. to 200° C. at a rate of temperature increase of 10° C./min. The temperature of the resin is increased to 180° C. once and held at the temperature for 10 minutes. Subsequently, the temperature is reduced to 30° C. and then increased again. In the second temperature increase process, a change in specific heat is obtained in the temperature range of from 30° C. to 100° C. The point of intersection of a line, which connects the midpoints of baselines before and after the appearance of the change in specific heat, and a differential thermal curve at this time is defined as the glass transition temperature (Tg) of the resin. Further, a heat quantity determined from the area of the highest endothermic peak of a temperature-endotherm curve in the temperature range of from 60° C. to 90° C. is defined as an endotherm.

<Measurement of DSC Endotherms (LH) of Wax and Crystalline Polyester>

The peak temperatures (Tp) of the highest endothermic peaks of the wax and the crystalline polyester in the present invention are measured with DSC Q2000 (manufactured by TA Instruments) under the following conditions.

Rate of temperature increase: 10° C./min

Measurement start temperature: 20° C.

Measurement end temperature: 180° C.

The melting points of indium and zinc are used for the temperature correction of the detecting portion of the apparatus, and the heat of fusion of indium is used for the correction of a heat quantity.

Specifically, about 5 mg of a sample is precisely weighed, loaded into a pan made of aluminum, and subjected to measurement once. An empty pan made of aluminum is used as a reference.

In the case where the toner is used as the sample, when the highest endothermic peak (highest endothermic peak derived from the binder resin) does not overlap the endothermic peak of a resin except the wax and the crystalline polyester, the endotherm of the resultant highest endothermic peak is treated as it is as the endotherm of the highest endothermic peak derived from the wax and the crystalline polyester. Meanwhile, in the case where the toner is used as the sample, when the endothermic peak of the resin except the wax and the crystalline polyester overlaps the highest endothermic peak of the binder resin, an endotherm derived from the resin except the wax and the crystalline polyester needs to be subtracted from the endotherm of the resultant highest endothermic peak.

The term "highest endothermic peak" means a peak having the highest endotherm when a plurality of peaks are present. In addition, the endotherm (LH) of the highest endothermic peak is determined from the area of the peak by calculation with analysis software included with the apparatus.

<Measurement of Weight-Average Molecular Weight by GPC>

A column is stabilized in a heat chamber at 40° C. THF is flowed as a solvent at a flow rate of 1 ml/min through the column at the temperature, and about 100 μl of a solution of a sample in THF is injected and subjected to measurement. At the time of the measurement of the molecular weight of the sample, the molecular weight distribution of the sample was calculated from a relationship between the logarithmic value of a calibration curve prepared with several kinds of monodisperse polystyrene standard samples, and a counted value. For example, samples manufactured by Tosoh Corporation or manufactured by Showa Denko K.K. each having a molecular weight of from about $10^2$ to about $10^7$ are used as the standard polystyrene samples for the preparation of the calibration curve, and it is proper to use at least about 10 standard polystyrene samples. In addition, a refractive index (RI) detector is used as a detector. A combination of a plurality of commercially available polystyrene gel columns is preferably used as the column, and examples thereof may include: a combination of Shodex GPC KF-801, 802, 803, 804, 805, 806, 807, and 800P manufactured by Showa Denko K.K.; and a combination of TSKgel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$), and TSKguard column manufactured by Tosoh Corporation.

In addition, the sample is produced as described below.

The sample is loaded into THF and left to stand at 25° C. for several hours. After that, the sample is sufficiently mixed with THF (until the coalesced body of the sample disappears) by sufficiently shaking the materials, and the mixture is further left at rest for 12 hours or more. At that time, the time period for which the sample is left to stand in THF is set to 24 hours. After that, the mixture is passed through a sample treatment filter (pore size: 0.2 μm or more and 0.5 μm or less, for example, MAISHORI DISC H-25-2 (manufactured by Tosoh Corporation) may be used) to provide a sample for GPC. In addition, the concentration of the sample is adjusted so that a resin component concentration may be 0.5 mg/ml or more and 5.0 mg/ml or less.

<Method of Measuring Weight-Average Particle Diameter (D4) of Toner Particles>

The weight-average particle diameter (D4) of the toner particles is measured with the number of effective measurement channels of 25,000 by using a precision particle size distribution-measuring apparatus based on a pore electrical resistance method provided with a 100-micrometer aperture tube "Coulter Counter Multisizer 3" (trademark, manufactured by Beckman Coulter, Inc.) and dedicated software included therewith "Beckman Coulter Multisizer 3 Version 3.51" (manufactured by Beckman Coulter, Inc.) for setting measurement conditions and analyzing measurement data. Then, the measurement data is analyzed to calculate the diameter.

An electrolyte aqueous solution prepared by dissolving guaranteed sodium chloride in ion-exchanged water so as to have a concentration of about 1 mass %, such as "ISOTON II" (manufactured by Beckman Coulter, Inc.), may be used in the measurement.

The dedicated software is set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a threshold/noise level measurement button. In addition, a current is set to 1,600 μA, a gain is set to 2, and an electrolyte solution is set to ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm or more and 60 μm or less.

A specific measurement method is as described below.

(1) About 200 ml of the electrolyte aqueous solution is charged into a 250-milliliter round-bottom beaker made of glass dedicated for the Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "aperture flush" function of the analytical software.

(2) About 30 ml of the electrolyte aqueous solution is charged into a 100-milliliter flat-bottom beaker made of glass. About 0.3 ml of a diluted solution prepared by diluting "Contaminon N" (a 10 mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with ion-exchanged water by three mass fold is added as a dispersant to the electrolyte aqueous solution.

(3) A predetermined amount of ion-exchanged water is charged into the water tank of an ultrasonic dispersing unit "Ultrasonic Dispension System Tetora 150" (manufactured by Nikkaki Bios Co., Ltd.) having an electrical output of 120 W in which two oscillators each having an oscillatory frequency of 50 kHz are built so as to be out of phase by 180°. About 2 ml of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) About 10 mg of toner is gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. The temperature of water in the water tank is appropriately adjusted to 10° C. or more and 40° C. or less in the ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) is calculated. An "average diameter" on the "analysis/volume statistics (arithmetic average)" screen of the dedicated software when the dedicated software is set to show a graph in a vol % unit is the weight-average particle diameter (D4).

<Structure of Resin (NMR)>

The structures of the resins (e.g., the olefin-based copolymer and the crystalline polyester) in the toner are analyzed by nuclear magnetic resonance spectrometric analysis ($^1$H-NMR).

Measurement apparatus: JNM-EX400 (JEOL Ltd.)
Measurement frequency: 400 MHz
Pulse condition: 5.0 μs
Frequency range: 10,500 Hz
Cumulated number: 1,024 times
Measurement solvent: DMSO-d6

A sample is dissolved in as large an amount as possible in DMSO-d6, and the measurement is performed under the above-mentioned conditions. The structure of the sample and the like are determined from the chemical shift value and proton ratio of a spectrum to be obtained.

<Method of Confirming Coating Layer with Transmission Electron Microscope>

Whether or not the coating layer is present on the surface of each of the toner particles may be confirmed with a transmission electron microscope (TEM).

When the toner is stained with ruthenium tetroxide, the olefin-based copolymer is obtained as a clear contrast. The olefin-based copolymer is stained more strongly than the amorphous resin having a carbonyl group is. This is probably because ruthenium tetroxide and a polyolefin moiety in the olefin-based copolymer interact with each other to make the permeation of the staining material into the olefin-based copolymer stronger than that into the organic component in each of the toner particles.

The amount of a ruthenium atom varies depending on the strength of the staining. Accordingly, a strongly stained portion becomes black on an observed image because the portion has many such atoms and hence does not transmit any electron beam, and a weakly stained portion becomes white on the observed image because the portion easily transmits electron beams. Accordingly, the amorphous polyester resin and the olefin-based copolymer can be distinguished from each other, and hence whether or not the coating layer is present on the surface of each of the toner particles can be verified.

A specific procedure is as described below.

An Os film (5 nm) and a naphthalene film (20 nm) were applied as protective films to the toner by using an osmium plasma coater (Filgen, Inc., OPC80T), and the resultant was embedded in a photocurable resin D800 (JEOL Ltd.). After that, a toner section having a thickness of 60 nm was produced with an ultrasonic ultramicrotome (Leica Microsystems, UC7) at a cutting speed of 1 mm/s.

The resultant section was stained by using a vacuum electron staining apparatus (Filgen, Inc., VSC4R1H) in a $RuO_4$ gas atmosphere at 500 Pa for 15 minutes, and was subjected to STEM observation with a TEM (JEOL Ltd., JEM-2800).

An image of the section having a size measuring 1,024×1,024 pixels was obtained at a probe size of the STEM of 1 nm. The obtained image was binarized (threshold: 120/255 stages) with image processing software "Image-Pro Plus (manufactured by Media Cybernetics)."

In addition, the coverage of a toner particle with the coating layer was calculated for 1,000 toner particles in the toner section image obtained by the STEM observation in accordance with the following equation, and the arithmetic average of the calculated values was determined.

Coverage with coating layer (%)=(the length of an interface between the coating layer having a layer thickness of 0.1 μm or more and a toner particle)/(the length of the circumference of the toner particle)×100

Further, the layer thicknesses of the coating layers were measured in the toner section image obtained by the STEM observation. The term "layer thickness" means the thickness of the coating layer from the surface of a toner particle to the surface of the toner. The thicknesses of the coating layer of each of 100 toner particles in the toner section were measured at 10 arbitrary points, and the arithmetic average of the measured values was defined as the average layer thickness of the coating layers.

Thus, whether or not the coating layer is present on the surface of each of the toner particles can be confirmed from the toner section image obtained with the TEM.

In addition, the crystalline polyester is stained more weakly than the olefin-based copolymer is because the polyester does not have any polyolefin moiety. Accordingly, when the toner contains the crystalline polyester, the crystalline polyester and the olefin-based copolymer can be distinguished from each other by their difference in contrast.

In the following Examples, the term "part(s)" means "part(s) by mass."

<Production Example of Amorphous Polyester Resin L>

Polyoxypropylene(2.2)-2,2-bis(4-hydroxyphenyl)propane: 76.9 parts (0.167 mol)
Terephthalic acid: 24.1 parts (0.145 mol)
Titanium tetrabutoxide: 0.5 part The above-mentioned materials were loaded into a 4-liter, four-necked flask made of glass. A temperature gauge, a stirring rod, a condenser, and a nitrogen-introducing tube were mounted to the flask, and the flask was set in a mantle heater. Next, the flask was purged with a nitrogen gas. After that, a temperature in the flask was gradually increased while the mixture was stirred. The mixture was subjected to a reaction for 4 hours while being stirred at a temperature of 200° C. (first reaction step).

Trimellitic anhydride: 3 parts
(0.01 mol; 4.0 mol % with respect to the total number of moles of polyvalent carboxylic acids)
tert-Butylcatechol (polymerization inhibitor): 0.1 part After that, the above-mentioned materials were added to the resultant, and the mixture was subjected to a reaction for 1 hour while a pressure in the reaction vessel was reduced to 8.3 kPa and a temperature therein was maintained at 180° C. It was confirmed that the softening point of the reaction product measured in accordance with ASTM D36-86 reached 90° C., and then the temperature was reduced to stop the reaction (second reaction step). Thus, a low-molecular weight amorphous polyester resin (L) was obtained.

The amorphous polyester resin (L) had an acid value of 10 mgKOH/g and a hydroxyl value of 65 mgKOH/g. In addition, its molecular weights measured by GPC were as follows: a weight-average molecular weight (Mw) of 8,000, a number-average molecular weight (Mn) of 3,500, and a peak molecular weight (Mp) of 5,700. The resin had a softening point of 90° C.

<Production Example of Amorphous Polyester Resin (H)>

Polyoxypropylene (2.2)-2,2-bis(4-hydroxyphenyl)propane: 72.3 parts
(0.20 mol; 100.0 mol % with respect to the total number of moles of a polyhydric alcohol)

Terephthalic acid: 18.3 parts
(0.11 mol; 65.0 mol % with respect to the total number of moles of polyvalent carboxylic acids)

Fumaric acid: 2.9 parts
(0.03 mol; 15.0 mol % with respect to the total number of moles of polyvalent carboxylic acids)

Tin 2-ethylhexanoate (esterification catalyst): 0.5 part

The above-mentioned materials were weighed into a reaction vessel with a cooling tube, a stirrer, a nitrogen-introducing tube, and a thermocouple. Next, the reaction vessel was purged with a nitrogen gas, and then a temperature in the reaction vessel was gradually increased while the materials were stirred. The materials were subjected to a reaction for 2 hours while being stirred at a temperature of 200° C. Further, a pressure in the reaction vessel was reduced to 8.3 kPa and maintained at the pressure for 1 hour. After that, the temperature was cooled to 180° C. and the pressure was returned to atmospheric pressure (first reaction step).

Trimellitic anhydride: 6.5 parts
(0.03 mol; 20.0 mol % with respect to the total number of moles of the polyvalent carboxylic acids)

tert-Butylcatechol (polymerization inhibitor): 0.1 part

After that, the above-mentioned materials were added to the resultant, and the mixture was subjected to a reaction for 15 hours while a pressure in the reaction vessel was reduced to 8.3 kPa and a temperature therein was maintained at 160° C. It was confirmed that the softening point of the reaction product measured in accordance with ASTM D36-86 reached 130° C., and then the temperature was reduced to stop the reaction (second reaction step). Thus, a high-molecular weight amorphous polyester resin (H) was obtained.

The amorphous polyester resin (H) had an acid value of 15 mgKOH/g and a hydroxyl value of 7 mgKOH/g. In addition, its molecular weights measured by GPC were as follows: a weight-average molecular weight (Mw) of 200,000, a number-average molecular weight (Mn) of 5,000, and a peak molecular weight (Mp) of 10,000. The resin had a softening point of 130° C.

<Production Example of Amorphous Polystyrene Resin>

Fifty parts of xylene was loaded into an autoclave, and the autoclave was purged with nitrogen. After that, a temperature in the autoclave was increased to 185° C. under stirring in a closed state. While the temperature in the autoclave was controlled to 185° C., a mixed solution of 95 parts of styrene, 5 parts of n-butyl acrylate, 5 parts of di-t-butyl peroxide, and 20 parts of xylene was continuously dropped for 3 hours to perform polymerization. Further, the polymerization was completed by maintaining the temperature for 1 hour, followed by the removal of the solvent. Thus, an amorphous polyester resin was obtained. The resultant amorphous polyester resin had a weight-average molecular weight (Mw) of 3,500, a softening point (Tm) of 96° C., and a glass transition temperature (Tg) of 58° C.

<Production Example of Olefin-Based Copolymer 1>

Under room temperature, an autoclave was purged with ethylene. After that, 120 parts of methanol and 1.0 part of 2,2'-azobis-(4-methoxy-2,4-dimethylvaleronitrile) were added to the autoclave. Next, the solution was saturated with ethylene by introducing ethylene and performing pressurization ($5.0\times10^6$ Pa) several times.

After a pressure in the autoclave had been set to $3.0\times10^5$ Pa (gauge pressure), 100 parts by mass of vinyl acetate was added to the resultant, and the mixture was stirred at 70° C. for 1 hour. At this time, the pressure of ethylene was held at $5.0\times10^6$ Pa by further metering and introducing ethylene. Thus, a reaction product was obtained.

The resultant reaction product was gradually dropped to 1,000 parts of methanol, and then the mixture was stirred at 100° C. for 30 minutes. Next, a precipitate was separated by filtration. A filter cake was washed with methanol several times to provide a polymer.

The resultant polymer was separated by filtration, and was dried at a pressure of $0.2\times10^5$ Pa and a temperature of 50° C. for 24 hours. After that, an olefin-based copolymer was obtained.

A solution was prepared by dissolving 10 parts of the resultant olefin-based copolymer in 30 parts of toluene. In parallel therewith, a solution was prepared by dissolving 0.5 part of a nonionic surfactant in 50 parts of ion-exchanged water. In room temperature, the solution of the olefin-based copolymer in toluene was dropped to the aqueous solution of the surfactant thus prepared while the latter solution was stirred with T.K. HOMOMIXER manufactured by PRIMIX Corporation. After that, the stirring of the mixture was continued at room temperature for 1 hour to provide an emulsion.

In room temperature, the resultant emulsion was gradually dropped to 300 parts of methanol, and the mixture was stirred with a three-one motor (propeller blade) for 20 minutes.

Deposited resin particles were separated by filtration, and were washed with 50 parts of ion-exchanged water 5 times. The resultant resin particles were dried at a pressure of $0.2\times10^5$ Pa and a temperature of 50° C. for 24 hours. After that, an olefin-based copolymer 1 (ethylene-vinyl acetate copolymer) was obtained. The physical properties and the like of the olefin-based copolymer 1 are shown in Table 1.

<Production Examples of Olefin-Based Copolymers 2 to 10>

Olefin-based copolymers 2 to 10 were each obtained by performing the same operation as that of the production example of the olefin-based copolymer 1 except that in the production example of the olefin-based copolymer 1, the conditions were appropriately changed so that $R_1$ to $R_5$ and the physical properties were as shown in Table 1. The physical properties and the like of the olefin-based copolymers 2 to 10 are shown in Table 1.

TABLE 1

| Olefin-based copolymer | $R_1$ | $R_2$ | $R_3$ | $R_4$ | $R_5$ | Particle diameter [nm] | Weight-average molecular weight |
|---|---|---|---|---|---|---|---|
| 1 | H | H | $CH_3$ | — | — | 100 | 100,000 |
| 2 | H | — | — | H | $CH_3$ | 130 | 90,000 |
| 3 | H | — | — | H | $C_2H_5$ | 200 | 105,000 |
| 4 | H | — | — | $CH_3$ | $CH_3$ | 150 | 85,000 |
| 5 | H | H | $C_2H_5$ | — | — | 300 | 70,000 |
| 6 | $CH_3$ | $CH_3$ | $C_2H_5$ | — | — | 150 | 50,000 |
| 7 | $CH_3$ | — | — | $CH_3$ | $C_2H_5$ | 180 | 16,500 |

TABLE 1-continued

| Olefin-based copolymer | $R_1$ | $R_2$ | $R_3$ | $R_4$ | $R_5$ | Particle diameter [nm] | Weight-average molecular weight |
|---|---|---|---|---|---|---|---|
| 8 | $CH_3$ | H | $C_2H_5$ | — | — | 230 | 15,000 |
| 9 | $CH_3$ | — | — | H | $C_2H_5$ | 180 | 17,000 |
| 10 | H | H | $C_3H_7$ | — | — | 330 | 20,000 |

<Production Example of Olefin-Based Copolymer 11>

Under room temperature, an autoclave was purged with ethylene. After that, 100 parts of norbornene and 120 parts of toluene were added to the autoclave. Next, the solution was saturated with ethylene by introducing ethylene and performing pressurization ($3.0\times10^5$ Pa) several times.

After a pressure in the autoclave had been set to $3.0\times10^5$ Pa (gauge pressure), a toluene solution obtained by dissolving 0.1 part of a methylaluminoxane in 1.0 part of toluene was dropped to the reactor, and the mixture was stirred at 70° C. for 15 minutes.

In parallel therewith, under room temperature, a two-necked flask was purged with nitrogen, and then 0.1 part of a methylaluminoxane was added to 1.0 part of toluene to be dissolved. Zero point three part of isopropylene (1-indenyl) cyclopentadienylzirconium dichloride was added to the resultant toluene solution, and the mixture was left to stand for 30 minutes to be preliminarily activated. The preliminarily activated complex solution was dropped to the above-mentioned norbornene reaction liquid.

The resultant mixture was stirred at 70° C. for 1 hour. At this time, the pressure of ethylene was held at $3.0\times10^5$ Pa by further metering and introducing ethylene. Thus, a reaction product was obtained.

The resultant reaction product was gradually dropped to 1,000 parts of acetone, and then the mixture was stirred for 10 minutes. Next, a precipitate was separated by filtration. A filter cake was alternately washed with hydrochloric acid having a concentration of 10% and acetone several times, and then the cake was washed with ion-exchanged water until the cake became neutral. Thus, a polymer was obtained.

The resultant polymer was separated by filtration, and was dried at a pressure of $0.2\times10^5$ Pa and a temperature of 80° C. for 20 hours. After that, an olefin-based copolymer was obtained.

A solution was prepared by dissolving 10 parts of the resultant olefin-based copolymer in 30 parts of toluene. In parallel therewith, a solution was prepared by dissolving 0.4 part of a nonionic surfactant in 40 parts of ion-exchanged water. In room temperature, the solution of the olefin-based copolymer in toluene was dropped to the aqueous solution of the surfactant thus prepared while the latter solution was stirred with T.K. HOMOMIXER manufactured by PRIMIX Corporation. After that, the stirring of the mixture was continued at room temperature for 1 hour to provide an emulsion.

In room temperature, the resultant emulsion was gradually dropped to 300 parts of methanol, and the mixture was stirred with a three-one motor (propeller blade) for 20 minutes.

Deposited resin particles were separated by filtration, and were washed with 30 parts of ion-exchanged water 4 times. The resultant resin particles were dried at a pressure of $0.2\times10^5$ Pa and a temperature of 80° C. for 20 hours. After that, an olefin-based copolymer 11 (weight-average diameter: 100 nm) was obtained.

<Production Example of Crystalline Polyester 1>

1,6-Hexanediol: 34.5 parts (0.29 mol; 100.0 mol % with respect to the total number of moles of a polyhydric alcohol)

Dodecanedioic acid: 65.5 parts (0.29 mol; 100.0 mol % with respect to the total number of moles of a polyvalent carboxylic acid)

Tin 2-ethylhexanoate: 0.5 part

The above-mentioned materials were weighed into a reaction vessel with a cooling tube, a stirrer, a nitrogen-introducing tube, and a thermocouple. The reaction vessel was purged with a nitrogen gas, and then a temperature in the reaction vessel was gradually increased while the materials were stirred. The materials were subjected to a reaction for 3 hours while being stirred at a temperature of 140° C.

Next, the above-mentioned material was added to the resultant, and the mixture was subjected to a reaction for 4 hours while a pressure in the reaction vessel was reduced to 8.3 kPa and a temperature therein was maintained at 200° C.

After that, the pressure in the reaction vessel was reduced to 5 kPa or less again, and the resultant was subjected to a reaction at 200° C. for 3 hours to provide a crystalline polyester 1.

<Production Examples of Crystalline Polyesters 2 to 6>

Crystalline polyesters 2 to 6 were each obtained by performing the same operation as that of the production example of the crystalline polyester 1 except that in the production example of the crystalline polyester 1, the conditions were appropriately changed so that the diol and the dicarboxylic acid were as shown in Table 2.

TABLE 2

| Crystalline polyester resin | Diol | Dicarboxylic acid |
|---|---|---|
| 1 | 1,6-Hexanediol (C6) | Dodecanedioic acid (C12) |
| 2 | 1,12-Dodecanediol (C12) | Hexanedioic acid (C6) |
| 3 | 1,10-Decanediol (C10) | Decanedioic acid (C10) |
| 4 | 1,10-Decanediol (C10) | Hexanedioic acid (C6) |
| 5 | 1,12-Dodecanediol (C12) | Decanedioic acid (C10) |
| 6 | 1,6-Hexanediol (C6) | Decanedioic acid (C10) |

<Production Example of Toner 1: Melt-Kneading Production Method Including Heat Treatment Step>

| | |
|---|---|
| Amorphous polyester resin (L) | 75.0 parts |
| Amorphous polyester resin (H) | 25.0 parts |
| Crystalline polyester 1 | 7.5 parts |
| Fischer-Tropsch wax (peak temperature of highest endothermic peak: 90° C.) | 5.0 parts |
| C.I. Pigment Blue 15:3 | 7.0 parts |
| Aluminum 3,5-di-t-butylsalicylate compound | 0.3 part |

The above-mentioned materials were mixed with a Henschel mixer (MODEL FM-75, manufactured by Nippon Coke & Engineering Co., Ltd.) at a number of revolutions of 20 $s^{-1}$ for a time of revolution of 5 minutes, and thereafter, the mixture was kneaded with a twin screw kneader (MODEL PCM-30, manufactured by Ikegai Corp.) whose temperature was set to 150° C. The kneaded product thus obtained was cooled and coarsely pulverized with a hammer mill to 1 mm or less to provide a coarsely pulverized product. The coarsely pulverized product thus obtained was finely pulverized with a mechanical pulverizer (T-250, manufactured by Freund-Turbo Corporation). Further, the finely pulverized product was classified with Faculty F-300 (manufactured by Hosokawa Micron Corporation) to provide toner particles 1. Its operating conditions were as follows: the number of revolutions of a classification rotor was set to 130 $s^{-1}$ and the number of revolutions of a dispersion rotor was set to 120 $s^{-1}$.

Five point zero parts of the olefin-based copolymer 1 was added to 100 parts of the resultant toner particles 1, and the materials were mixed with a Henschel mixer (MODEL FM-75, manufactured by Nippon Coke & Engineering Co., Ltd.) at a number of revolutions of 30 $s^{-1}$ for a time of revolution of 10 minutes. The resultant mixture was thermally treated with a surface treatment apparatus illustrated in FIGURE to provide hot air sticking-treated toner particles. The apparatus was operated under the conditions of a feeding amount of 5 kg/hr, a hot air temperature C of 150° C., a hot air flow rate of 6 $m^3$/min, a cold air temperature E of 5° C., a cold air flow rate of 4 $m^3$/min, a cold air absolute water content of 3 g/$m^3$, a blower flow rate of 20 $m^3$/min, and an injection air flow rate of 1 $m^3$/min.

One point zero part of hydrophobic silica fine particles subjected to surface treatment with 4 mass % of hexamethyldisilazane, the fine particles having a BET specific surface area of 25 $m^2$/g, and 0.8 part of hydrophobic silica fine particles subjected to surface treatment with 10 mass % of a polydimethylsiloxane, the fine particles having a BET specific surface area of 100 $m^2$/g, were added to 100 parts of the resultant thermally treated toner particles 1, and the materials were mixed with a Henschel mixer (MODEL FM-75, manufactured by Nippon Coke & Engineering Co., Ltd.) at a number of revolutions of 30 $s^{-1}$ for a time of revolution of 10 minutes to provide a toner 1.

In the differential scanning calorimetry of the resultant toner 1, an endothermic peak derived from the crystalline polyester was observed. In addition, TEM observation confirmed that a coating layer containing the olefin-based copolymer was formed on the surface of each of the toner particles of the toner 1. The physical properties of the toner are shown in Table 3.

<Production Example of Toner 2: Melt-Kneading Production Method>

Toner particles 2 were obtained by the same production method as that of the toner particles 1 except that in the production example of the toner 1, the condition was appropriately changed so that the kind of the crystalline polyester was as shown in Table 3.

Five point zero parts of the olefin-based copolymer 1 was added to 100 parts of the resultant toner particles 2. The materials were loaded into NOBILTA (manufactured by Hosokawa Micron Corporation), and were mixed at a number of revolutions of 150 $s^{-1}$ for a time of revolution of 10 minutes to provide resin particles 2 in which the surfaces of the toner particles 2 were coated with the olefin-based copolymer 1.

One point zero part of hydrophobic silica fine particles subjected to surface treatment with 4 mass % of hexamethyldisilazane, the fine particles having a BET specific surface area of 25 $m^2$/g, and 0.8 part of hydrophobic silica fine particles subjected to surface treatment with 10 mass % of a polydimethylsiloxane, the fine particles having a BET specific surface area of 100 $m^2$/g, were added to 100 parts of the resultant resin particles 2, and the materials were mixed with a Henschel mixer (MODEL FM-75, manufactured by Nippon Coke & Engineering Co., Ltd.) at a number of revolutions of 30 $s^{-1}$ for a time of revolution of 10 minutes to provide a toner 2.

In the differential scanning calorimetry of the resultant toner 2, an endothermic peak derived from the crystalline polyester was observed. In addition, TEM observation confirmed that a coating layer containing the olefin-based copolymer was formed on the surface of each of the toner particles of the toner 2. The physical properties of the toner are shown in Table 3.

<Production Example of Toner 3: Melt-Kneading Production Method>

Toner particles 3 were obtained by performing the same operation as that of the production example of the toner 1 except that the conditions were appropriately changed so that the kind and content of the crystalline polyester were as shown in Table 3.

Seven point zero parts of the olefin-based copolymer 1 was added to 100 parts of the resultant toner particles 3. The materials were loaded into MECHANO HYBRID (manufactured by Nippon Coke & Engineering Co., Ltd.), and were mixed at a number of revolutions of 160 $s^{-1}$ for a time of revolution of 5 minutes to provide treated toner particles 3 in which the surfaces of the toner particles 3 were coated with the olefin-based copolymer 1.

One point zero part of hydrophobic silica fine particles subjected to surface treatment with 4 mass % of hexamethyldisilazane, the fine particles having a BET specific surface area of 25 $m^2$/g, and 0.8 part of hydrophobic silica fine particles subjected to surface treatment with 10 mass % of a polydimethylsiloxane, the fine particles having a BET specific surface area of 100 $m^2$/g, were added to 100 parts of the resultant treated toner particles 3, and the materials were mixed with a Henschel mixer (MODEL FM-75, manufactured by Nippon Coke & Engineering Co., Ltd.) at a number of revolutions of 30 $s^{-1}$ for a time of revolution of 10 minutes to provide a toner 3.

In the differential scanning calorimetry of the resultant toner 3, an endothermic peak derived from the crystalline polyester was observed. In addition, TEM observation confirmed that a coating layer containing the olefin-based copolymer was formed on the surface of each of the toner particles of the toner 3. The physical properties of the toner are shown in Table 3.

<Production Example of Toner 4: Emulsion Aggregation Production Method>

(Amorphous Polyester Resin-Dispersed Liquid)

An amorphous polyester resin-dispersed liquid (solid content: 20%) was obtained by: dispersing the amorphous polyester resins (L) and (H) in ion-exchanged water so that a composition ratio between the ion-exchanged water and the amorphous polyester resins became 80%:20% in terms of a concentration; adjusting the pH of the resultant to 8.5 with ammonia; and operating CAVITRON under the condition of a heating temperature of 100° C. to treat the resultant.

(Crystalline Polyester-Dispersed Liquid)

Eighty parts of the crystalline polyester 4 and 720 parts of ion-exchanged water were each loaded into a stainless-steel beaker and heated to 100° C. When the crystalline polyester 4 melted, the mixture was stirred with a homogenizer. Next, emulsion dispersion was performed while 2.0 parts of an anionic surfactant (solid content: 20%) was dropped to the mixture. Thus, a dispersed liquid of the crystalline polyester 4 (solid content: 10%) was obtained.

(Colorant-Dispersed Liquid)

| | |
|---|---|
| C.I. Pigment Blue 15:3 | 1,000 parts |
| Anionic surfactant | 150 parts |
| Ion-exchanged water | 9,000 parts |

The above-mentioned materials were mixed and dissolved, followed by dispersion with a high-pressure impact-type dispersing machine. The colorant particles in the resultant colorant-dispersed liquid had a volume-average particle diameter D50 of 0.16 μm and a colorant concentration of 23%.

(Wax-Dispersed Liquid)

| | |
|---|---|
| Fischer-Tropsch wax (peak temperature of the highest endothermic peak: 90° C.) | 45 parts |
| Anionic surfactant | 5 parts |
| Ion-exchanged water | 150 parts |

The above-mentioned materials were heated to 95° C. and dispersed with a homogenizer. After that, the resultant was subjected to dispersion treatment with a pressure ejection-type Gaulin homogenizer. Thus, a wax-dispersed liquid (wax concentration: 20%) obtained by dispersing a release agent having a volume-average particle diameter of 210 nm was prepared.

| | |
|---|---|
| Amorphous polyester resin-dispersed liquid | 500 parts |
| Dispersed liquid of the crystalline polyester 4 | 60 parts |

The above-mentioned materials were mixed and dispersed with a homogenizer in a round-bottom flask made of stainless steel. Zero point one five part of a polyaluminum chloride was added to the resultant, and a dispersion operation was continued with ULTRA-TURRAX.

| | |
|---|---|
| Colorant-dispersed liquid | 30.5 parts |
| Wax-dispersed liquid | 25 parts |

After that, the above-mentioned materials were added to the resultant. Further, 0.05 part of a polyaluminum chloride was added to the mixture, and a dispersion operation was continued with ULTRA-TURRAX.

A stirrer and a mantle heater were placed, and the temperature of the resultant slurry was increased to 60° C. while the number of revolutions of the stirrer was adjusted so that the slurry was sufficiently stirred. After the temperature had been held at 60° C. for 15 minutes, the particle diameters of particles in the slurry were measured with COULTER MULTISIZER III (aperture diameter: 50 μm, manufactured by Beckman Coulter, Inc.) every 10 minutes while the temperature was increased at 0.05° C./min. When the weight-average particle diameter of the particles became 6.3 μm, the pH of the slurry was adjusted to 9.0 with a 5% aqueous solution of sodium hydroxide. After that, the temperature was increased to 96° C. at a rate of temperature increase of 1° C./min while the pH was adjusted to 9.0 every 5° C. After that, the temperature was held at 96° C. The shapes and surface properties of the particles were observed with an optical microscope and a scanning electron microscope (FE-SEM) every 30 minutes. As a result, the particles were sphered in the fifth hour, and hence the temperature was decreased to 20° C. at 1° C./min to solidify the particles. Thus, toner particles 4 were obtained.

A solution of the olefin-based copolymer 2 was obtained by dissolving 100 parts of the olefin-based copolymer 2 in a mixed solvent of 200 parts of toluene and 100 parts of isopropyl alcohol.

In room temperature, 14 parts of a 10% aqueous solution of ammonia was dropped over a drop time of 5 minutes while the solution of the olefin-based copolymer 2 thus prepared was stirred with T.K. HOMOMIXER manufactured by PRIMIX Corporation, followed by mixing for 10 minutes.

Further, 900 parts of ion-exchanged water was dropped to the mixture at a rate of 7 parts/min to perform phase inversion. Thus, an emulsion was obtained. Eight hundred parts of the resultant emulsion and 700 parts of ion-exchanged water were immediately loaded into a 2-liter recovery flask, and the flask was set in an evaporator including a vacuum control unit through a trap sphere.

Under a state in which the recovery flask was rotated, the organic solvents were removed while attention was paid to bumping. After that, the recovery flask was cooled with ice. Thus, a dispersed liquid was obtained. Ion-exchanged water was added to the dispersed liquid to adjust its solid content concentration to 20%. Thus, a dispersed liquid of the olefin-based copolymer 2 was obtained.

One hundred parts of the toner particles 4 were circulated in the fluidized bed of a particle coating apparatus MODEL SFP-01 (manufactured by Powrex Corporation) at a supply air temperature of 80° C. Next, 22.5 parts of the dispersed liquid of the olefin-based copolymer 2 was sprayed into the fluidized bed of the particle coating apparatus MODEL SFP-01 (manufactured by Powrex Corporation) at a spraying rate of 0.4 part/min for 60 minutes. Thus, resin particles 4 were obtained.

One hundred parts of the resultant resin particles 4 were treated with a spray dry coating apparatus to provide treated toner particles 4 in which the surfaces of the toner particles 4 were coated with 4.0 parts of the olefin-based copolymer 2.

One point zero part of hydrophobic silica fine particles subjected to surface treatment with 4 mass % of hexamethyldisilazane, the fine particles having a BET specific surface area of 25 $m^2/g$, and 0.8 part of hydrophobic silica fine particles subjected to surface treatment with 10 mass % of a polydimethylsiloxane, the fine particles having a BET specific surface area of 100 $m^2/g$, were added to 100 parts of the treated toner particles 4, and the materials were mixed with a Henschel mixer (MODEL FM-75, manufactured by Nippon Coke & Engineering Co., Ltd.) at a number of revolutions of 30 $s^{-1}$ for a time of revolution of 10 minutes to provide a toner 4.

In the differential scanning calorimetry of the resultant toner 4, an endothermic peak derived from the crystalline polyester was observed. In addition, TEM observation confirmed that a coating layer containing the olefin-based copolymer was formed on the surface of each of the toner particles of the toner 4. The physical properties of the toner are shown in Table 3.

<Production Example of Toner 5: Emulsion Aggregation Production Method>

(Amorphous Polyester Resin-Dispersed Liquid)

An amorphous polyester resin-dispersed liquid (solid content: 20%) was obtained by: dispersing the amorphous polyester resins (L) and (H) in ion-exchanged water so that a composition ratio between the ion-exchanged water and the amorphous polyester resins became 80%:20% in terms of a concentration; adjusting the pH of the resultant to 8.5 with ammonia; and operating CAVITRON under the condition of a heating temperature of 100° C. to treat the resultant.

(Olefin-Based Copolymer-Dispersed Liquid)

An oil layer was obtained by dissolving 100 parts of the olefin-based copolymer 3 in 200 parts of toluene and 100 parts of isopropyl alcohol. In room temperature, 14 parts of a 10 mass % aqueous solution of ammonia was dropped over a drop time of 5 minutes while the solution of the olefin-based copolymer 3 thus prepared was stirred with T.K. HOMOMIXER manufactured by PRIMIX Corporation, followed by mixing for 10 minutes. Further, 900 parts of ion-exchanged water was dropped to the mixture at a rate of 7 parts by mass/min to perform phase inversion. Thus, an emulsion was obtained.

Eight hundred parts of the resultant emulsion and 700 parts of ion-exchanged water were immediately loaded into a 2-liter recovery flask, and the flask was set in an evaporator including a vacuum control unit through a trap sphere. Under a state in which the recovery flask was rotated, the solvents were removed while attention was paid to bumping. After that, the recovery flask was cooled with ice. Thus, a dispersed liquid was obtained. Ion-exchanged water was added to the dispersed liquid to adjust its solid content concentration to 20 mass %. Thus, an olefin-based copolymer-dispersed liquid was obtained.

(Crystalline Polyester-Dispersed Liquid)

Eighty parts of the crystalline polyester 5 and 720 parts of ion-exchanged water were each loaded into a stainless-steel beaker and heated to 100° C. When the crystalline polyester 5 melted, the mixture was stirred with a homogenizer. Next, emulsion dispersion was performed while 2.0 parts of an anionic surfactant (solid content: 20%) was dropped to the mixture. Thus, a dispersed liquid of the crystalline polyester 5 (solid content: 10%) was obtained.

(Colorant-Dispersed Liquid)

| | |
|---|---|
| C.I. Pigment Blue 15:3 | 1,000 parts |
| Anionic surfactant | 150 parts |
| Ion-exchanged water | 9,000 parts |

The above-mentioned materials were mixed and dissolved, followed by dispersion with a high-pressure impact-type dispersing machine. The colorant particles in the resultant colorant-dispersed liquid had a volume-average particle diameter D50 of 0.16 μm and a colorant concentration of 23%.

(Wax-Dispersed Liquid)

| | |
|---|---|
| Fischer-Tropsch wax (peak temperature of the highest endothermic peak: 90° C.) | 45 parts |
| Anionic surfactant | 5 parts |
| Ion-exchanged water | 150 parts |

The above-mentioned materials were heated to 95° C. and dispersed with a homogenizer. After that, the resultant was subjected to dispersion treatment with a pressure ejection-type Gaulin homogenizer. Thus, a wax-dispersed liquid (wax concentration: 20%) obtained by dispersing a release agent having a volume-average particle diameter of 210 nm was prepared.

| | |
|---|---|
| Amorphous polyester resin-dispersed liquid | 500 parts |
| Dispersed liquid of the crystalline polyester 5 | 10 parts |

The above-mentioned materials were mixed and dispersed with a homogenizer in a round-bottom flask made of stainless steel. Zero point one five part of a polyaluminum chloride was added to the resultant, and a dispersion operation was continued with ULTRA-TURRAX.

| | |
|---|---|
| Colorant-dispersed liquid | 30.5 parts |
| Wax-dispersed liquid | 25 parts |

After that, the above-mentioned materials were added to the resultant. Further, 0.05 part of a polyaluminum chloride was added to the mixture, and a dispersion operation was continued with ULTRA-TURRAX.

A stirrer and a mantle heater were placed, and the temperature of the resultant slurry was increased to 60° C. while the number of revolutions of the stirrer was adjusted so that the slurry was sufficiently stirred. After the temperature had been held at 60° C. for 15 minutes, the particle diameters of particles in the slurry were measured with COULTER MULTISIZER III (aperture diameter: 50 μm, manufactured by Beckman Coulter, Inc.) every 10 minutes while the temperature was increased at 0.05° C./min. When the weight-average particle diameter of the particles became 6.7 μm, 30.0 parts of the dispersed liquid of the olefin-based copolymer 3 (additional resin) was loaded into the slurry over 3 minutes. After the loading, the mixture was held for 30 minutes and then its pH was adjusted to 9.0 with a 5% aqueous solution of sodium hydroxide.

After that, the temperature was increased to 96° C. at a rate of temperature increase of 1° C./min while the pH was adjusted to 9.0 every 5° C. After that, the temperature was held at 96° C. The shapes and surface properties of the particles were observed with an optical microscope and a scanning electron microscope (FE-SEM) every 30 minutes. As a result, the particles were sphered in the fifth hour, and hence the temperature was decreased to 20° C. at 1° C./min to solidify the particles.

After that, the reaction product was filtered and sufficiently washed with ion-exchanged water, followed by drying with a vacuum dryer. Thus, toner particles 5 were obtained.

One point zero part of hydrophobic silica fine particles subjected to surface treatment with 4 mass % of hexamethyldisilazane, the fine particles having a BET specific surface area of 25 $m^2/g$, and 0.8 part of hydrophobic silica fine particles subjected to surface treatment with 10 mass % of a polydimethylsiloxane, the fine particles having a BET specific surface area of 100 $m^2/g$, were added to 100 parts of the toner particles 5, and the materials were mixed with a Henschel mixer (MODEL FM-75, manufactured by Nippon Coke & Engineering Co., Ltd.) at a number of revolutions of 30 $s^{-1}$ for a time of revolution of 10 minutes to provide a toner 5.

In the differential scanning calorimetry of the resultant toner 5, an endothermic peak derived from the crystalline polyester was observed. In addition, TEM observation confirmed that a coating layer containing the olefin-based copolymer was formed on the surface of each of the toner particles of the toner 5. The physical properties of the toner are shown in Table 3.

<Production Examples of Toners 6 and 7>

Toners 6 and 7 were each obtained by performing the same operation as that of the production example of the toner 5 except that in the production example of the toner 5, the conditions were appropriately changed so that the kinds and contents of the crystalline polyester and the olefin-based copolymer were as shown in Table 3.

In the differential scanning calorimetry of each of the resultant toners 6 and 7, an endothermic peak derived from the crystalline polyester was observed. In addition, TEM observation confirmed that a coating layer containing the olefin-based copolymer was formed on the surface of each of the toner particles of each of the toners 6 and 7. The physical properties of the toners are shown in Table 3.

<Production Examples of Toners 8 to 14>

Toners 8 to 14 were each obtained by performing the same operation as that of the production example of the toner 5 except that in the production example of the toner 5, no crystalline polyester was added, and the conditions were appropriately changed so that the kind and content of the olefin-based copolymer were as shown in Table 3.

The TEM observation of each of the resultant toners 8 to 14 confirmed that a coating layer containing the olefin-based copolymer was formed on the surface of each of the toner particles. The physical properties of the toners are shown in Table 3.

<Production Example of Toner 15>

A toner 15 was obtained by performing the same operation as that of the production example of the toner 5 except that in the production example of the toner 5, no crystalline polyester was added, and the conditions were appropriately changed so that the kind and content of the olefin-based copolymer, and the kind of the wax were as shown in Table 3.

The TEM observation of the resultant toner 15 confirmed that a coating layer containing the olefin-based copolymer was formed on the surface of each of the toner particles. The physical properties of the toner are shown in Table 3.

<Production Example of Toner 16>

A toner 16 was obtained by performing the same operation as that of the production example of the toner 1 except that in the production example of the toner 1, 100 parts of the polystyrene was used instead of the amorphous polyester.

In the differential scanning calorimetry of the resultant toner 16, an endothermic peak derived from the crystalline polyester was observed. In addition, TEM observation confirmed that a coating layer containing the olefin-based copolymer was formed on the surface of each of the toner particles of the toner 16. The physical properties of the toner are shown in Table 3.

<Production Example of Toner 17>

A toner 17 was obtained by performing the same operation as that of the production example of the toner 2 except that in the production example of the toner 2, no crystalline polyester was added, and the kind and content of the olefin-based copolymer were changed.

TEM observation confirmed that a coating layer containing the olefin-based copolymer was formed on the surface of each of the toner particles of the toner 17. The physical properties of the toner are shown in Table 3.

<Production Example of Toner 18>

(Polystyrene Resin-Dispersed Liquid)

A polystyrene resin-dispersed liquid (solid content: 20%) was obtained by: dispersing a polystyrene resin in ion-exchanged water so that a composition ratio between the ion-exchanged water and the polystyrene resin became 80%:20% in terms of a concentration; adjusting the pH of the resultant to 8.5 with ammonia; and operating CAVITRON under the condition of a heating temperature of 100° C. to treat the resultant.

(Olefin-Based Copolymer-Dispersed Liquid)

An oil layer was obtained by dissolving 100 parts of the olefin-based copolymer 1 in 200 parts of toluene and 100 parts of isopropyl alcohol. In room temperature, 14 parts of a 10 mass % aqueous solution of ammonia was dropped over a drop time of 5 minutes while the solution of the olefin-based copolymer 1 thus prepared was stirred with T.K. HOMOMIXER manufactured by PRIMIX Corporation, followed by mixing for 10 minutes. Further, 900 parts of ion-exchanged water was dropped to the mixture at a rate of 7 parts by mass/min to perform phase inversion. Thus, an emulsion was obtained.

Eight hundred parts of the resultant emulsion and 700 parts of ion-exchanged water were immediately loaded into a 2-liter recovery flask, and the flask was set in an evaporator including a vacuum control unit through a trap sphere. Under a state in which the recovery flask was rotated, the solvents were removed while attention was paid to bumping. After that, the recovery flask was cooled with ice. Thus, a dispersed liquid was obtained. Ion-exchanged water was added to the dispersed liquid to adjust its solid content concentration to 20 mass %. Thus, an olefin-based copolymer-dispersed liquid was obtained.

(Colorant-Dispersed Liquid)

| | |
|---|---|
| C.I. Pigment Blue 15:3 | 1,000 parts |
| Anionic surfactant | 150 parts |
| Ion-exchanged water | 9,000 parts |

The above-mentioned materials were mixed and dissolved, followed by dispersion with a high-pressure impact-type dispersing machine. The colorant particles in the resultant colorant-dispersed liquid had a volume-average particle diameter D50 of 0.16 μm and a colorant concentration of 23%.

(Wax-Dispersed Liquid)

| | |
|---|---|
| Fischer-Tropsch wax (peak temperature of the highest endothermic peak: 90° C.) | 45 parts |
| Anionic surfactant | 5 parts |
| Ion-exchanged water | 150 parts |

The above-mentioned materials were heated to 95° C. and dispersed with a homogenizer. After that, the resultant was subjected to dispersion treatment with a pressure ejection-type Gaulin homogenizer. Thus, a wax-dispersed liquid (wax concentration: 20%) obtained by dispersing a release agent having a volume-average particle diameter of 210 nm was prepared.

| | |
|---|---|
| Styrene acrylic resin-dispersed liquid | 500 parts |
| Dispersed liquid of the olefin-based copolymer 1 | 25 parts |

The above-mentioned materials were mixed and dispersed with a homogenizer in a round-bottom flask made of stainless steel. Zero point one five part of a polyaluminum chloride was added to the resultant, and a dispersion operation was continued with ULTRA-TURRAX.

| | |
|---|---|
| Colorant-dispersed liquid | 30.5 parts |
| Wax-dispersed liquid | 25 parts |

After that, the above-mentioned materials were added to the resultant. Further, 0.05 part of a polyaluminum chloride was added to the mixture, and a dispersion operation was continued with ULTRA-TURRAX.

A stirrer and a mantle heater were placed, and the temperature of the resultant slurry was increased to 60° C. while the number of revolutions of the stirrer was adjusted so that the slurry was sufficiently stirred. After the temperature had been held at 60° C. for 15 minutes, the particle diameters of particles in the slurry were measured with COULTER MULTISIZER III (aperture diameter: 50 μm, manufactured by Beckman Coulter, Inc.) every 10 minutes while the temperature was increased at 0.05° C./min. When the weight-average particle diameter of the particles became 7.6 μm, the pH of the slurry was adjusted to 9.0 with a 5% aqueous solution of sodium hydroxide. After that, the temperature was increased to 96° C. at a rate of temperature increase of 1° C./min while the pH was adjusted to 9.0 every 5° C. After that, the temperature was held at 96° C. The shapes and surface properties of the particles were observed with an optical microscope and a scanning electron microscope (FE-SEM) every 30 minutes. As a result, the particles were sphered in the fifth hour, and hence the temperature was decreased to 20° C. at 1° C./min to solidify the particles.

After that, the reaction product was filtered and sufficiently washed with ion-exchanged water, followed by drying with a vacuum dryer. Thus, toner particles 18 were obtained.

One point zero part of hydrophobic silica fine particles subjected to surface treatment with 4 mass % of hexamethyldisilazane, the fine particles having a BET specific surface area of 25 $m^2/g$, and 0.8 part of hydrophobic silica fine particles subjected to surface treatment with 10 mass % of a polydimethylsiloxane, the fine particles having a BET specific surface area of 100 $m^2/g$, were added to 100 parts of the toner particles 18, and the materials were mixed with a Henschel mixer (MODEL FM-75, manufactured by Nippon Coke & Engineering Co., Ltd.) at a number of revolutions of 30 $s^{-1}$ for a time of revolution of 10 minutes to provide a toner 18.

TABLE 3

| | Formulation | | | | | | | | |
|---|---|---|---|---|---|---|---|---|---|
| | | | | Olefin-based copolymer | | | | | |
| | Amorphous resin | | | | | Ratio of unit derived | | Crystalline polyester | |
| Toner | L (part(s)) | H (part(s)) | Polystyrene (part(s)) | Kind of resin | Part(s) | from formula (2) or formula (3) | (l + m + n)/W | Kind of resin | Part(s) |
| 1 | 75.0 | 25.0 | — | 1 | 5.0 | 15.0 | 0.99 | 1 | 7.5 |
| 2 | 75.0 | 25.0 | — | 1 | 5.0 | 15.0 | 0.99 | 2 | 7.5 |
| 3 | 75.0 | 25.0 | — | 1 | 7.0 | 15.0 | 0.99 | 3 | 6.0 |
| 4 | 75.0 | 25.0 | — | 2 | 4.0 | 10.0 | 0.99 | 4 | 6.0 |
| 5 | 75.0 | 25.0 | — | 3 | 6.0 | 20.0 | 0.99 | 5 | 1.0 |
| 6 | 75.0 | 25.0 | — | 4 | 9.0 | 18.0 | 0.99 | 6 | 15.0 |
| 7 | 75.0 | 25.0 | — | 1 + 2 | 8.0 | 25.0 | 0.99 | 7 | 20.0 |
| 8 | 75.0 | 25.0 | — | 5 | 3.0 | 8.0 | 0.95 | — | — |
| 9 | 75.0 | 25.0 | — | 6 | 10.0 | 13.0 | 0.90 | — | — |
| 10 | 75.0 | 25.0 | — | 7 | 20.0 | 23.0 | 0.88 | — | — |
| 11 | 75.0 | 25.0 | — | 8 | 1.0 | 28.0 | 0.93 | — | — |
| 12 | 75.0 | 25.0 | — | 9 | 30.0 | 5.0 | 0.85 | — | — |
| 13 | 75.0 | 25.0 | — | 10 | 30.0 | 33.0 | 0.83 | — | — |
| 14 | 75.0 | 25.0 | — | 10 | 30.0 | 33.0 | 0.80 | — | — |
| 15 | 75.0 | 25.0 | — | 10 | 30.0 | 33.0 | 0.50 | — | — |
| 16 | — | — | 100.0 | 1 | 5.0 | 15.0 | 0.99 | — | — |
| 17 | 75.0 | 25.0 | — | 11 | 5.0 | — | — | — | — |
| 18 | — | — | 100.0 | 1 | 5.0 | 20.0 | — | — | — |

| | Formulation | | | Thermally treated toner particles | | | | Resin layer | |
|---|---|---|---|---|---|---|---|---|---|
| | Wax | | | | | Production method | | | |
| Toner | Kind of wax | Melting point (° C.) | Part(s) | Average circularity | Weight-average particle diameter (μm) | Production method | Hot air treatment | Average layer thickness (μm) | Resin coverage (%) |
| 1 | W1 | 90 | 5.0 | 0.976 | 6.5 | P1 | Present | 0.4 | 100 |
| 2 | W1 | 90 | 5.0 | 0.965 | 6.1 | P1 | Absent | 0.5 | 95 |
| 3 | W1 | 90 | 5.0 | 0.969 | 6.9 | P1 | Absent | 0.5 | 95 |
| 4 | W1 | 90 | 5.0 | 0.961 | 6.3 | P2 | Absent | 0.5 | 95 |
| 5 | W1 | 90 | 5.0 | 0.967 | 6.7 | P2 | Absent | 0.5 | 95 |
| 6 | W1 | 90 | 5.0 | 0.963 | 6.2 | P2 | Absent | 0.3 | 95 |
| 7 | W1 | 90 | 5.0 | 0.955 | 6.8 | P2 | Absent | 0.3 | 95 |
| 8 | W1 | 90 | 5.0 | 0.959 | 6.4 | P2 | Absent | 0.3 | 95 |
| 9 | W1 | 90 | 5.0 | 0.957 | 6.6 | P2 | Absent | 0.7 | 93 |
| 10 | W1 | 90 | 5.0 | 0.962 | 6.5 | P2 | Absent | 1 | 94 |
| 11 | W1 | 90 | 5.0 | 0.968 | 6.1 | P2 | Absent | 0.1 | 93 |
| 12 | W1 | 90 | 5.0 | 0.964 | 6.9 | P2 | Absent | 1 | 98 |
| 13 | W1 | 90 | 5.0 | 0.966 | 6.3 | P2 | Absent | 1 | 98 |
| 14 | W1 | 90 | 5.0 | 0.965 | 6.7 | P2 | Absent | 1 | 98 |
| 15 | W2 | 90 | 5.0 | 0.969 | 6.2 | P2 | Absent | 1 | 98 |
| 16 | W1 | 90 | 5.0 | 0.961 | 6.8 | P1 | Present | 0.4 | 96 |
| 17 | W1 | 90 | 5.0 | 0.967 | 6.4 | P1 | Absent | 0.5 | 96 |
| 18 | W1 | 90 | 5.0 | 0.960 | 6.6 | P2 | Absent | 0.5 | 96 |

The "part(s)" of an olefin-based copolymer represents an amount with respect to 100 parts of toner particles, and the "amount" of each of a crystalline polyester and a wax represents an amount with respect to 100 parts of a binder resin (amorphous resin).
In the column "Kind of wax," W1 represents Fischer-Tropsch wax and W2 represents carnauba wax.
In the column "Production method," P1 represents a melt-kneading method and P2 represents an emulsion aggregation method.

<Production Example of Magnetic Carrier Particles 1>

Step 1 (Weighing/Mixing Step):

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

Ferrite raw materials were weighed so that the above-mentioned materials had the above-mentioned composition ratio. After that, the materials were pulverized and mixed with a dry vibrating mill using stainless-steel beads each having a diameter of ⅛ inch for 5 hours.

Step 2 (Pre-Calcining Step):

The resultant pulverized product was turned into a square pellet about 1 mm on a side with a roller compacter. Coarse powder was removed from the pellet with a vibrating sieve having an aperture of 3 mm. Then, fine powder was removed therefrom with a vibrating sieve having an aperture of 0.5 mm. After that, the remainder was calcined under a nitrogen atmosphere (oxygen concentration: 0.01 vol %) with a burner-type calcining furnace at a temperature of 1,000° C. for 4 hours to produce a pre-calcined ferrite. The composition of the resultant pre-calcined ferrite is as described below.

$$(MnO)_a(MgO)_b(SrO)_c(Fe_2O_3)_d$$

In the formula, a=0.257, b=0.117, c=0.007, and d=0.393.

Step 3 (Pulverizing Step):

The pre-calcined ferrite was pulverized with a crusher into pieces each having a size of about 0.3 mm. After that, 30 parts of water with respect to 100 parts of the pre-calcined ferrite was added to the pieces, and then the mixture was pulverized with a wet ball mill using zirconia beads each having a diameter of ⅛ inch for 1 hour. The resultant slurry was pulverized with a wet ball mill using alumina beads each having a diameter of 1/16 inch for 4 hours. Thus, a ferrite slurry (finely pulverized product of the pre-calcined ferrite) was obtained.

Step 4 (Granulating Step):

One point zero part of ammonium polycarboxylate serving as a dispersant and 2.0 parts of polyvinyl alcohol serving as a binder with respect to 100 parts of the pre-calcined ferrite were added to the ferrite slurry, and then the mixture was granulated into spherical particles with a spray drier (manufacturer: Ohkawara Kakohki Co., Ltd.). The particle sizes of the resultant particles were adjusted, and then the dispersant and the binder serving as organic components were removed by heating the particles with a rotary kiln at 650° C. for 2 hours.

Step 5 (Calcining Step):

In order for a calcining atmosphere to be controlled, the temperature of the remainder was increased from room temperature to a temperature of 1,300° C. in an electric furnace under a nitrogen atmosphere (having an oxygen concentration of 1.00 vol %) in 2 hours, and then the remainder was calcined at a temperature of 1,150° C. for 4 hours. After that, the temperature of the calcined product was decreased to a temperature of 60° C. over 4 hours and the nitrogen atmosphere was returned to the air. When its temperature became 40° C. or less, the calcined product was taken out.

Step 6 (Sorting Step):

After an agglomerated particle had been shredded, a low-magnetic force product was discarded by magnetic separation, and coarse particles were removed by sieving with a sieve having an aperture of 250 μm. Thus, magnetic carrier particles 1 having a 50% particle diameter (D50) on a volume distribution basis of 37.0 μm were obtained.

<Preparation of Coating Resin 1>

| | |
|---|---|
| Cyclohexyl methacrylate monomer | 26.8 mass % |
| Methyl methacrylate monomer | 0.2 mass % |
| Methyl methacrylate macromonomer (macromonomer having a methacryloyl group at one terminal and having a weight-average molecular weight of 5,000) | 8.4 mass % |
| Toluene | 31.3 mass % |
| Methyl ethyl ketone | 31.3 mass % |
| Azobisisobutyronitrile | 2.0 mass % |

Of the above-mentioned materials, cyclohexyl methacrylate, methyl methacrylate, the methyl methacrylate macromonomer, toluene, and methyl ethyl ketone were added to a four-necked separable flask with a reflux condenser, a temperature gauge, a nitrogen-introducing tube, and a stirrer. Then, a nitrogen gas was introduced into the flask to sufficiently establish a nitrogen atmosphere. After that, the temperature of the mixture was increased to 80° C., azobisisobutyronitrile was added to the mixture, and the whole was polymerized by being refluxed for 5 hours. Hexane was injected into the resultant reaction product to precipitate and deposit a copolymer, and then the precipitate was separated by filtration. After that, the precipitate was vacuum-dried to provide a coating resin 1. Thirty parts of the resultant coating resin 1 was dissolved in 40 parts of toluene and 30 parts of methyl ethyl ketone. Thus, a polymer solution 1 (solid content: 30 mass %) was obtained.

<Preparation of Coating Resin Solution 1>

| | |
|---|---|
| Polymer solution 1 (resin solid content concentration: 30%) | 33.3 mass % |
| Toluene | 66.4 mass % |
| Carbon black (primary particle diameter: 25 nm, nitrogen adsorption specific surface area: 94 $m^2/g$, DBP oil absorption: 75 ml/100 g) | 0.3 mass % |

The above-mentioned materials were dispersed with a paint shaker using zirconia beads each having a diameter of 0.5 mm for 1 hour. The resultant dispersion liquid was filtered through a 5.0-micrometer membrane filter. Thus, a coating resin solution 1 was obtained.

<Production Example of Magnetic Carrier 1>

(Resin Coating Step):

The coating resin solution 1 was charged into a vacuum deaeration-type kneader maintained at normal temperature so that its amount in terms of a resin component was 2.5 parts with respect to 100 parts of the filled magnetic carrier particles 1. After having been charged, the solution was stirred at a rotational speed of 30 rpm for 15 minutes. After a certain amount (80 mass %) or more of the solvent had been volatilized, the temperature in the kneader was increased to 80° C. while the remaining contents were mixed under reduced pressure. Toluene was removed by distillation over 2 hours and then the residue was cooled. A low-magnetic force product was separated from the resultant magnetic carrier by magnetic separation and then the remainder was passed through a sieve having an aperture of 70 μm. After that, the resultant was classified with an air classifier. Thus, a magnetic carrier 1 having a 50% particle diameter (D50) on a volume distribution basis of 38.2 μm was obtained.

Each of the above-mentioned toners 1 to 18 and the magnetic carrier 1 were mixed with a V-type mixer (MODEL V-10: Tokuju Corporation) at 0.5 $s^{-1}$ for a time of revolution of 5 minutes so that a toner concentration became 8.0 mass %. Thus, two-component developers 1 to 18 were obtained.

Example 1

A digital multifunction machine imageRUNNER ADVANCE C9075 PRO manufactured by Canon Inc. was used as an image-forming apparatus, and was reconstructed so that its fixation temperature and process speed could be freely set.

Evaluations to be described later were performed by: loading a two-component developer into a developing unit at the cyan position of the reconstructed machine; and adjusting a DC voltage $V_{DC}$ of a developer carrier, a charging voltage $V_D$ of an electrostatic latent image-bearing member, and laser power so that a toner laid-on level on the electrostatic latent image-bearing member or paper became a desired value. The results are shown in Table 4.

<Evaluation 1: Chargeability, Maintenance Ratio of Q/M (mC/kg) after Standing>

The triboelectric charge quantity and toner laid-on level of a toner on the electrostatic latent image-bearing member were calculated by sucking and collecting the toner with a metal cylindrical tube and a cylindrical filter.

Specifically, the triboelectric charge quantity and toner laid-on level of the toner on the electrostatic latent image-bearing member were measured with a Faraday cage.

The Faraday cage refers to a coaxial double cylinder, and its inner cylinder and outer cylinder are isolated from each other. When a charged body having a charge quantity Q is loaded into the inner cylinder, a state as if a metal cylinder having the charge quantity Q was present is established by electrostatic induction. The induced charge quantity was measured with an electrometer (KEITHLEY 6517A manufactured by Keithley Instruments), and a value (Q/M) obtained by dividing the charge quantity Q (mC) by a mass M (kg) of the toner in the inner cylinder was defined as the triboelectric charge quantity of the toner.

In addition, a toner laid-on level per unit area was determined by: measuring an area S of a region where the suction was performed; and dividing the mass M of the toner by the area S ($cm^2$) of the region where the suction was performed.

The triboelectric charge quantity and toner laid-on level of the toner were measured by: stopping the rotation of the electrostatic latent image-bearing member before a toner layer formed on the electrostatic latent image-bearing member was transferred onto an intermediate transfer member; and directly sucking a toner image on the electrostatic latent image-bearing member with air.

Toner laid-on level ($mg/cm^2$)=M/S

Triboelectric charge quantity of toner (mC/kg)=Q/M

In the image-forming apparatus, under a high-temperature and high-humidity environment (32.5° C., 80% RH), the toner laid-on level on the electrostatic latent image-bearing member was adjusted to 0.35 $mg/cm^2$, and the toner was sucked and collected with the metal cylindrical tube and the cylindrical filter. At that time, the charge quantity Q stored in a capacitor through the metal cylindrical tube and the mass M of the collected toner were measured, and a charge quantity Q/M (mC/kg) per unit mass was calculated and defined as the charge quantity Q/M (mC/kg) per unit mass on the electrostatic latent image-bearing member (initial evaluation).

After the above-mentioned evaluation (initial evaluation) had been performed, the developing unit was removed to the outside of the machine, and was left to stand under the high-temperature and high-humidity environment (32.5° C., 80% RH) for 48 hours. After the standing, the developing unit was mounted in the machine again, and the charge quantity Q/M per unit mass on the electrostatic latent image-bearing member was measured at the same DC voltage $V_{DC}$ as that of the initial evaluation (evaluation after standing).

The charge quantity Q/M per unit mass on the electrostatic latent image-bearing member in the initial evaluation was defined as 100%, and the maintenance ratio (evaluation after standing/initial evaluation×100) of the charge quantity Q/M per unit mass on the electrostatic latent image-bearing member after the 48 hours of standing (evaluation after standing) was calculated and evaluated by the following criteria.

Evaluation criteria are as described below.

A: Q/M maintenance ratio on the electrostatic latent image-bearing member of 90% or more: extremely satisfactory B: Q/M maintenance ratio on the electrostatic latent image-bearing member of 80% or more and less than 90%: satisfactory C: Q/M maintenance ratio on the electrostatic latent image-bearing member of 70% or more and less than 80%: somewhat satisfactory D: Q/M maintenance ratio on the electrostatic latent image-bearing member of 60% or more and less than 70%: related-art level (acceptable level in the present invention)

E: Q/M maintenance ratio on the electrostatic latent image-bearing member of less than 60%: level inferior to the related-art level (unacceptable in the present invention)

The result of the evaluation of the toner 1 by the above-mentioned evaluation method and criteria is shown in Table 4.

<Evaluation 2: Evaluation for Durability Low-print Percentage Mode>

In this evaluation, a toner was evaluated for its durability by observing its transferability after endurance.

CS-680 (68.0 $g/m^2$) (sold from Canon Marketing Japan Inc.) was used as evaluation paper.

In the endurance, 100,000 A4 charts were continuously passed. An evaluation for transferability was performed by: developing a toner having a toner laid-on level of 0.35 $mg/cm^2$ on a photosensitive drum; shutting down the operation of the main body of the image-forming apparatus during a transferring step; taping a transfer residual toner remaining on the photosensitive drum; and measuring the density of the toner on the tape. An optimum value was used as a transfer current setting in accordance with the charge quantity of the toner. X-Rite Color Reflection Densitometer (500 Series: manufactured by X-Rite Inc.) was used in the density measurement.

Evaluation criteria are as described below (the initial toner is ranked A in each of all Examples and Comparative Examples).

A: Less than 0.08: extremely satisfactory

B: 0.08 or more and less than 0.11: satisfactory

C: 0.11 or more and less than 0.13: somewhat satisfactory

D: 0.13 or more and less than 0.16: related-art level (acceptable level in the present invention)

E: 0.16 or more: level inferior to the related-art level (unacceptable in the present invention)

The result of the evaluation of the toner 1 by the above-mentioned evaluation method and criteria is shown in Table 4.

<Evaluation 3: Hot Offset Resistance>

Paper: CS-680 (68.0 g/$m^2$)

(sold from Canon Marketing Japan Inc.)

Toner laid-on level: 0.08 mg/$cm^2$

Evaluation image: An image having an area of 10 $cm^2$ was arranged on each of both terminals of the A4 paper.

Fixation test environment: Normal-temperature and low-humidity environment: temperature of 23° C./humidity of 5% RH (hereinafter referred to as "N/L")

After the unfixed image had been produced, the process speed was set to 450 mm/sec, the fixation temperature was increased from 150° C. in increments of 5° C., and an evaluation for hot offset resistance was performed. A procedure for the evaluation is as described below. First, 10 plain postcards were passed on the center of a fixing belt, and then the unfixed image was passed. A value for fogging was used as an indicator of the evaluation for hot offset resistance. The fogging was calculated from the following equation by measuring an average reflectance Dr (%) of evaluation paper before a fixation test and a reflectance Ds (%) of a white portion after a fixation test with a reflectometer ("REFLECTOMETER MODEL TC-6DS" manufactured by Tokyo Denshoku Co., Ltd.).

$$\text{Fogging}\ (\%)=Dr(\%)-Ds(\%)$$

In this embodiment, the surface layer of each of the toner particles is coated with an olefin-based copolymer poor in fixability to paper. However, an affinity for the wax component in each of the toner particles varies depending on the structure of the olefin-based copolymer, and the hot offset resistance varies depending on the ease with which the wax and the olefin-based copolymer mix with each other at the time of the fixation. In addition, the dispersibility of the wax varies depending on a toner particle production process, and hence an influence on the hot offset resistance may occur. Evaluation criteria are as described below.

A: Less than 0.4%: extremely satisfactory

B: 0.4% or more and less than 0.6%: satisfactory

C: 0.6% or more and less than 0.8%: somewhat satisfactory

D: 0.8% or more and less than 1.0%: related-art level (acceptable level in the present invention)

E: 1.0% or more: level inferior to the related-art level (unacceptable in the present invention)

The result of the evaluation of the toner 1 by the above-mentioned evaluation method and criteria is shown in Table 4.

<Evaluation 4: Low-Temperature Fixability>

Paper: CS-680 (68.0 g/$m^2$)

(sold from Canon Marketing Japan Inc.)

Toner laid-on level on paper: 1.20 mg/$cm^2$

Evaluation image: An image having an area of 10 $cm^2$ was arranged on the center of the A4 paper.

Fixation test environment: Low-temperature and low-humidity environment: temperature of 15° C./humidity of 10% RH (hereinafter referred to as "L/L")

The DC voltage $V_{DC}$ of the developer carrier, the charging voltage $V_D$ of the electrostatic latent image-bearing member, and the laser power were adjusted so that a toner laid-on level on the paper became the above-mentioned value. After that, the low-temperature fixability of the toner was evaluated by setting the process speed and the fixation temperature to 450 mm/sec and 130° C., respectively. A value for an image density reduction ratio was used as an indicator of the evaluation for low-temperature fixability. The image density reduction ratio is measured as described below. First, the image density of a central portion is measured with X-Rite Color Reflection Densitometer (500 Series: manufactured by X-Rite). Next, a load of 4.9 kPa (50 g/$cm^2$) is applied to the portion whose image density has been measured, the fixed image is rubbed with lens-cleaning paper (5 reciprocations), and the image density is measured again. Then, the ratio (%) at which the image density reduces after the rubbing as compared to that before the rubbing is measured.

Evaluation criteria are as described below.

A: Image density reduction ratio of less than 1.0%: extremely satisfactory

B: Image density reduction ratio of 1.0% or more and less than 4.0%: satisfactory C: Image density reduction ratio of 4.0% or more and less than 7.0%: somewhat satisfactory D: Image density reduction ratio of 7.0% or more and less than 10.0%: related-art level (acceptable level in the present invention)

E: Image density reduction ratio of 10.0% or more: level inferior to the related-art level (unacceptable in the present invention)

The result of the evaluation of the toner 1 by the above-mentioned evaluation method and criteria is shown in Table 4.

In Example 1, each of the chargeability, the durability, the hot offset resistance, and the low-temperature fixability was extremely satisfactory.

Examples 2 to 15 and Comparative Examples 1 to 3

The results of the evaluations of the toners and the developers by the above-mentioned evaluation methods and criteria are shown in Table 4.

In each of Examples 2 and 3, the hot offset resistance slightly reduced as compared to that of Example 1 because the toner particles were not thermally treated and hence the wax did not migrate to the vicinity of the surface of the toner.

In Example 4, the hot offset resistance reduced as compared to that of Example 3 because the emulsion aggregation method was adopted as a toner production method and hence the dispersibility of the wax reduced.

In Example 5, the low-temperature fixability reduced as compared to that of Example 4 because the addition amount of the crystalline polyester was reduced and hence the plasticizing effect of the crystalline polyester became smaller.

In Example 6, the low-temperature fixability reduced as compared to that of Example 5 because the addition amount of the crystalline polyester was increased but its kind was changed to a polyester formed of the diol C12 and the dicarboxylic acid C10, and hence the plasticizing effect of the crystalline polyester became smaller.

In Example 7, the chargeability reduced as compared to that of Example 6 because the addition amount of the crystalline polyester was increased and hence the crystalline polyester was slightly deposited on the surface of the toner.

In Example 8, the low-temperature fixability reduced as compared to that of Example 7 because no crystalline polyester was added and hence the plasticizing effect of the crystalline polyester became smaller.

In Example 9, the chargeability reduced as compared to that of Example 8 because the molecular weight of the olefin-based copolymer was reduced.

In Example 10, the durability reduced as compared to that of Example 9 because the molecular weight of the olefin-based copolymer was reduced and the parts by mass of the olefin-based copolymer in the toner was increased.

In Example 11, the durability reduced as compared to that of Example 9 because the parts by mass of the olefin-based copolymer was reduced.

In Example 12, the durability reduced as compared to that of Example 9 because the parts by mass of the olefin-based copolymer was increased.

In Example 13, the durability reduced as compared to that of Example 12 because the kind of the olefin-based copolymer was changed.

In Example 14, the maintenance ratio of the Q/M (mC/kg) after the standing reduced as compared to that of Example 13 because the value for the ratio (l+m+n)/W was reduced.

In Example 15, the hot offset resistance reduced as compared to that of Example 13 because the value for the ratio (l+m+n)/W was reduced.

In Comparative Example 1, unlike Example 1, the polystyrene was used as the binder resin of each of the toner particles. As a result, the following result was obtained: the maintenance ratio of the Q/M (mC/kg) after the standing was at the level unacceptable in the present invention.

In Comparative Example 2, unlike Example 1, the toner was produced without the incorporation of a crystalline polyester and without the formation of a coating layer containing an olefin-based copolymer. As a result, the following results were obtained: the durability and the maintenance ratio of the Q/M (mC/kg) after the standing were each at the level unacceptable in the present invention.

In Comparative Example 3, unlike Example 1, the toner was produced by using the polystyrene as the binder resin of each of the toner particles, and without the incorporation of a crystalline polyester and without the formation of a coating layer containing an olefin-based copolymer. As a result, the following results were obtained: the durability and the low-temperature fixability were each at the level unacceptable in the present invention.

According to the present invention, specifically, there can be obtained a toner that does not deteriorate even when used for a long time period and that can maintain stable chargeability even under a high-humidity environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-228676, filed Nov. 25, 2016, which is hereby incorporated by reference herein in its entirety.

What is claimed is:

1. A toner, comprising toner particles each containing an amorphous polyester resin and a wax, wherein:

a surface of each of the toner particles has a coating layer;

the coating layer contains at least one kind of olefin-based copolymer selected from a group of resins each having at least a structural unit represented by the following formula (1) and a structural unit represented by the following formula (2) and/or the following formula (3); and an arithmetic average of ratios of the units represented by the formulae (2) and (3) with respect to the olefin-based copolymer is 3 mass % or more and 35 mass % or less:

Formula (1)

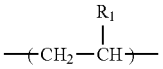

TABLE 4

| Example | Two-component developer | Chargeability: Initial Q/M (mC/kg) | Chargeability: Q/M after standing (mC/kg) | Chargeability: Q/M maintenance ratio (%) | Chargeability: Evaluation | Evaluation for durability: Transfer residual density (%) | Evaluation for durability: Evaluation | Hot offset resistance: Fogging (%) | Hot offset resistance: Evaluation | Low-temperature fixability: Density reduction ratio (%) | Low-temperature fixability: Evaluation |
|---|---|---|---|---|---|---|---|---|---|---|---|
| Example 1 | 1 | 38.6 | 36.8 | 95.3 | A | 0.01 | A | 0.2 | A | 0.2 | A |
| Example 2 | 2 | 36.4 | 34.3 | 94.2 | A | 0.05 | A | 0.4 | B | 0.3 | A |
| Example 3 | 3 | 34.2 | 32.2 | 94.2 | A | 0.04 | A | 0.5 | B | 0.4 | A |
| Example 4 | 4 | 36.1 | 33.7 | 93.4 | A | 0.03 | A | 0.6 | C | 0.5 | A |
| Example 5 | 5 | 35.7 | 33.4 | 93.6 | A | 0.05 | A | 0.6 | C | 2.0 | B |
| Example 6 | 6 | 37.9 | 35.4 | 93.4 | A | 0.04 | A | 0.7 | C | 3.0 | B |
| Example 7 | 7 | 35.1 | 33.4 | 95.2 | B | 0.07 | A | 0.7 | C | 2.0 | B |
| Example 8 | 8 | 33.5 | 29.7 | 88.7 | B | 0.02 | A | 0.7 | C | 4.5 | C |
| Example 9 | 9 | 38.0 | 28.2 | 74.2 | C | 0.01 | A | 0.6 | C | 5.0 | C |
| Example 10 | 10 | 35.9 | 28.2 | 78.6 | C | 0.08 | B | 0.6 | C | 6.0 | C |
| Example 11 | 11 | 35.6 | 27.4 | 77.0 | C | 0.09 | B | 0.6 | C | 5.1 | C |
| Example 12 | 12 | 35.8 | 27.3 | 76.3 | C | 0.12 | C | 0.6 | C | 4.8 | C |
| Example 13 | 13 | 35.8 | 27.0 | 75.4 | C | 0.13 | D | 0.6 | C | 6.5 | C |
| Example 14 | 14 | 31.5 | 20.6 | 65.4 | D | 0.14 | D | 0.6 | C | 4.3 | C |
| Example 15 | 15 | 31.2 | 20.6 | 66.0 | D | 0.13 | D | 0.8 | D | 6.1 | C |
| Comparative Example 1 | 16 | 30.7 | 16.1 | 52.4 | E | 0.14 | D | 0.8 | D | 7.0 | D |
| Comparative Example 2 | 17 | 30.7 | 16.1 | 52.4 | E | 0.17 | E | 0.9 | D | 9.5 | D |
| Comparative Example 3 | 18 | 31.5 | 20.6 | 65.4 | D | 0.18 | E | 0.9 | D | 10.0 | E |

-continued

Formula (2)

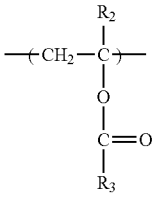

Formula (3)

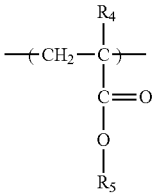

where $R_1$ represents H or $CH_3$, $R_2$ represents H or $CH_3$, $R_3$ represents $CH_3$, $C_2H_5$ or $C_3H_7$, $R_4$ represents H or $CH_3$, and $R_5$ represents $CH_3$ or $C_2H_5$.

2. A toner according to claim 1, wherein when a total sum of a mass of the at least one kind of olefin-based copolymer is represented by W, and masses of the units represented by the formula (1), the formula (2), and the formula (3) are represented by 1, m, and n, respectively, a weighted average of a ratio (l+m+n)/W of the olefin-based copolymer to be incorporated into a binder resin is 0.80 or more.

3. A toner according to claim 1, wherein the olefin-based copolymer comprises one of an ethylene-vinyl acetate copolymer having the units represented by the formula (1) and the formula (2) in which $R_1$ represents H, $R_2$ represents H, and $R_3$ represents $CH_3$, an ethylene-methyl acrylate copolymer having the units represented by the formula (1) and the formula (3) in which $R_1$ represents H, $R_4$ represents H, and $R_5$ represents $CH_3$, an ethylene-ethyl acrylate copolymer having the units represented by the formula (1) and the formula (3) in which $R_1$ represents H, $R_4$ represents H, and $R_5$ represents $C_2H_5$, and an ethylene-methyl methacrylate copolymer having the units represented by the formula (1) and the formula (3) in which $R_1$ represents H, $R_4$ represents $CH_3$, and $R_5$ represents $CH_3$.

4. A toner according to claim 1, wherein a content of the at least one kind of olefin-based copolymer is 1 part by mass or more and 40 parts by mass or less with respect to 100 parts by mass of the toner particles.

5. A toner according to claim 1, wherein the olefin-based copolymer has a weight-average molecular weight of 50,000 or more.

* * * * *